US012173627B2

(12) United States Patent
Mayer et al.

(10) Patent No.: US 12,173,627 B2
(45) Date of Patent: Dec. 24, 2024

(54) SYSTEM FOR READYING SUB-CRITICAL AND SUPER-CRITICAL STEAM GENERATOR, SERVICING METHOD OF SAID SUB-CRITICAL AND SUPER-CRITICAL STEAM GENERATOR AND METHOD OF OPERATION OF SUB-CRITICAL AND SUPER-CRITICAL STEAM GENERATOR

(71) Applicant: GENERAL ELECTRIC TECHNOLOGY GMBH, Baden (CH)

(72) Inventors: Ralph Mayer, Granby, CT (US); Wolfgang Franz Dietrich Mohr, Niederweningen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 260 days.

(21) Appl. No.: 17/968,920

(22) Filed: Oct. 19, 2022

(65) Prior Publication Data

US 2024/0133319 A1 Apr. 25, 2024
US 2024/0229683 A9 Jul. 11, 2024

(51) Int. Cl.
*F01K 7/24* (2006.01)
*F01K 3/02* (2006.01)
(Continued)

(52) U.S. Cl.
CPC ..... *F01K 7/24* (2013.01); *F01K 3/02* (2013.01); *F01K 3/186* (2013.01); *F01K 3/205* (2013.01);
(Continued)

(58) Field of Classification Search
CPC ..... F01K 3/18–267
See application file for complete search history.

(56) References Cited

U.S. PATENT DOCUMENTS 44,851 A 11/1864 Champlin
192,036 A 6/1877 Vanosdol
(Continued)

FOREIGN PATENT DOCUMENTS

EP 0419839 4/1991
EP 0908603 4/1999
(Continued)

OTHER PUBLICATIONS

Beevers et al., "On the Prediction and Theory of the Temperature Increase of Low Pressure Last Stage Moving Blades During Low vol. Flow Condition, and Limiting it Through Steam Extraction Methods", Proceedings of ASME Turbo Expro 2014, Turbine Technical Conference and Exposition, GT 2014, Jun. 16-20, 2014, Dusseldorf, Germany.

*Primary Examiner* — Laert Dounis
(74) *Attorney, Agent, or Firm* — Grogan, Tuccillo & Vanderleeden LLP

(57) ABSTRACT

A system for readying sub-critical and super-critical steam generator, a servicing method of the sub-critical and the super-critical steam generator and a method of operation of sub-critical and super-critical steam generator is provided. The steam generator includes a first auxiliary heating device disposed on at least one water-steam separator for heating the at least one water-steam separator, and/or a second auxiliary heating device disposed at least on a part of furnace top-end piping for heating the furnace top-end piping. The auxiliary heating devices are heating steam producing components of the steam generator and thus allowing to keep them above the temperature in which materials creating the steam producing components are brittle. The method includes recirculation of the water through the steam generator.

14 Claims, 6 Drawing Sheets

(51) Int. Cl.

| | |
|---|---|
| ***F01K 3/18*** | (2006.01) |
| ***F01K 3/20*** | (2006.01) |
| ***F01K 3/26*** | (2006.01) |
| ***F01K 7/38*** | (2006.01) |
| ***F01K 11/02*** | (2006.01) |
| ***F01K 13/02*** | (2006.01) |
| ***F22B 5/04*** | (2006.01) |
| ***F22B 35/04*** | (2006.01) |
| ***F22B 35/14*** | (2006.01) |
| ***F22B 37/26*** | (2006.01) |

(52) U.S. Cl.

CPC ..... *F01K 3/26* (2013.01); *F01K 7/38* (2013.01); *F01K 11/02* (2013.01); *F01K 13/02* (2013.01); *F22B 5/04* (2013.01); *F22B 35/04* (2013.01); *F22B 35/14* (2013.01); *F22B 37/261* (2013.01)

(56) References Cited

U.S. PATENT DOCUMENTS

| | | | | |
|---|---|---|---|---|
| 3,163,009 | A | 12/1964 | Rankin | |
| 3,169,373 | A * | 2/1965 | Hanzalek | F22D 11/00 122/448.3 |
| 4,048,012 | A | 9/1977 | George et al. | |
| 4,554,889 | A | 11/1985 | Lilly | |
| 5,029,443 | A | 7/1991 | Hauser | |
| 5,042,246 | A | 8/1991 | Moore et al. | |
| 5,396,865 | A | 3/1995 | Freeh | |
| 5,412,936 | A | 5/1995 | Lee et al. | |
| 5,687,674 | A | 11/1997 | Johanntgen et al. | |
| 6,851,266 | B2 | 2/2005 | Liebig | |
| 7,107,774 | B2 | 9/2006 | Radovich | |
| 8,276,382 | B2 | 10/2012 | Hu et al. | |
| 8,573,196 | B2 | 11/2013 | Plotkin et al. | |
| 8,776,521 | B2 | 7/2014 | Tong et al. | |
| 8,820,078 | B1 | 9/2014 | Duffy | |
| 9,228,452 | B2 | 1/2016 | Terdalkar et al. | |
| 9,347,685 | B2 | 5/2016 | Plotkin et al. | |
| 9,803,504 | B2 | 10/2017 | Park | |
| 10,968,784 | B2 | 4/2021 | Yan et al. | |
| 11,022,005 | B2 | 6/2021 | Levin | |
| 11,125,118 | B1 | 9/2021 | Mambro et al. | |
| 2005/0034445 | A1 | 2/2005 | Radovich | |
| 2010/0236240 | A1 | 9/2010 | Hu et al. | |
| 2012/0031395 | A1 | 2/2012 | Plotkin et al. | |
| 2013/0044851 | A1 | 2/2013 | Winters et al. | |
| 2014/0007614 | A1 | 1/2014 | Thacker et al. | |
| 2015/0113988 | A1 | 4/2015 | Ichinose et al. | |
| 2015/0192036 | A1 | 7/2015 | Sharp et al. | |
| 2016/0115869 | A1 | 4/2016 | Migl et al. | |
| 2017/0058702 | A1 | 3/2017 | Park | |
| 2021/0285335 | A1 * | 9/2021 | Mambro | F01K 13/02 |
| 2022/0213815 | A1 * | 7/2022 | Walsh | F22G 1/165 |

FOREIGN PATENT DOCUMENTS

| | | |
|---|---|---|
| GB | 1382342 | 1/1975 |
| JP | 5183305 | 4/2013 |

* cited by examiner

SYSTEM FOR READYING SUB-CRITICAL AND SUPER-CRITICAL STEAM GENERATOR, SERVICING METHOD OF SAID SUB-CRITICAL AND SUPER-CRITICAL STEAM GENERATOR AND METHOD OF OPERATION OF SUB-CRITICAL AND SUPER-CRITICAL STEAM GENERATOR

CROSS REFERENCE TO RELATED APPLICATIONS

The present patent application is related by subject matter to concurrently filed, co-pending, and commonly assigned International Application No. PCT/IB2022/060053, entitled SYSTEM FOR READYING SUB-CRITICAL AND SUPER-CRITICAL STEAM GENERATOR, SERVICING METHOD OF SAID SUB-CRITICAL AND SUPER-CRITICAL STEAM GENERATOR AND METHOD OF OPERATION OF SUB-CRITICAL AND SUPER-CRITICAL STEAM GENERATOR, the disclosure of which is incorporated herein by reference in its entirety.

BACKGROUND

Technical Field

Embodiments of this disclosure relate generally to steam generators for steam power plants, and more specifically, to a system and method for readying a steam generator, such as a sub-critical or a super-critical steam generator, for fast start-up with immediate auxiliary heating and degassed water filling, which function best in combination with a steam turbine in hot standby.

Discussion of Art

A steam generator such as a sub-critical or a super-critical steam generator typically includes a furnace in which fuel is burned to create thermal energy or heat to produce steam. The generated steam can be used in a steam turbine to drive an electric generator to produce electricity or provide heat for other purposes. Examples of said steam generator include a boiler.

Intermitted electricity markets because of renewables, have changed the demand on steam generators originally made for base load operation. Current operation is with low capacity factors and on very short notice times. Accordingly, the start-up time and related costs have become an important factor in the rentability of plants incorporating said steam generators.

Today, plants with Combined Cycle Gas Turbines (CCGT) in warm or hot standby allow significantly shorted startup times. The standby technology applied to steam turbines operated in boiler power plants is usually of low economic interest, as the combined boiler—turbine start-up is strongly affected by the time consumed by the transition of the boiler from standstill to steam turbine release (hereinafter also called "boiler transition"), and by further boiler delays providing steam of acceptable quality to a steam turbine.

The time from standstill to a firing mode of operation (i.e., a mode in which steam of sufficient quality is produced and ultimately used to generate electricity with a steam turbine) is a major commercial factor in generating revenues for utility boiler power plants due to intermittent electricity prices. Many efforts are done to shorten that time in order to be more responsive to electricity demands. These efforts are also aimed at reducing startup costs to be more competitive in the electricity market.

The boiler transition begins with a furnace purge before an auxiliary fuel system (also called auxiliary fuel combustor) is fired. The auxiliary fuel system includes an auxiliary fuel. The auxiliary fuel (also called start-up fuel) produces a controlled and limited amount of heat to generate first process steam and is used to safely warm up boiler components, such as a boiler drum, separator, or waterwall. The auxiliary fuel system runs until the boiler is ready to safely absorb the heat of the primary fuel combustors. Safe warm up and safe absorption involves possible thermal expansion and fatigue of said boiler components. Once the primary fuel is ignited, continued firing of the auxiliary fuel system allows a better heat control while ramping up the pressure in a power plant including the boiler. The net use of the auxiliary fuel is an essential part of the startup cost. Additionally, a decrease of use of the auxiliary fuel during startup contributes to decreasing environmental impact.

In addition to the above-mentioned safe component warm up, warming up of the boiler also requires prevention of flow-accelerated corrosion (FAC), corrosion fatigue, and other deteriorating effects like formation of deposits in the turbine. Said deteriorating effects originates from properties of water and they contribute to the combined start-up time of a power plant including the steam generator and the steam turbine. State of the art solutions to said deteriorating effects include a standalone deaerator, or a condenser-based sparger to degas the water steam cycle (WSC) and a blow down on the boiler drum to desalinate the WSC in the case of a sub-critical boiler.

The limitations to shorten the time that it takes to transition from the standstill mode to the firing mode originate from the masses of metal which need to be heated up within safe temperature rise criteria to control thermal stress fatigue on the components of the steam generator. Said masses limit, for example, the temperature increase rate as well as the maximum temperature differentials between material and water or steam temperatures for each component, e.g., of the boiler and/or of the steam turbine. The temperature increase rate and differential limits are material grade dependent. In practice, material thickness is the most relevant limitation. Hence, thick-walled components determine the time required to safely pass the transition of the boiler. Well-known examples of the thick-walled components include the boiler drum in a sub-critical steam generator or the separator in a super-critical steam generator.

Boiler materials may be brittle at low temperatures, i.e., have lower durability than in a ductile state. The transition, starting with some of the components being brittle, further limits the possible shortening of the time of transition. A greater temperature differential can be tolerated with increasing temperature of the components as metal of the components becomes ductile. In case of brittle components, the heat-up process must initially be controlled by carefully rising feedwater temperature in the waterwall. This control is imposed by lowering of the auxiliary fuel firing rate which produces a lower fuel flow and a clearly extended firing time. This increases the net use of the auxiliary fuel.

The limitation to shorten the time needed to reach sufficient steam quality to release the steam turbine is another factor prolonging the transition from the standstill mode to the firing mode of the steam generator. This involves filling of water circuits of the steam generator which takes considerable time. In the case of the sub-critical steam generator, the water needs to pass an economizer, the boiler drum, a boiler drum downcomer, and a waterwall inlet header before filling waterwall tubes. In the case of the super-critical steam generator, the incoming water must pass the economizer, a furnace waterwall, the separator, separator drains and a boiler feed water recirculation system.

Filing with water can additionally be extended if contaminated water is used. This includes the time needed to remove dissolved gases (by recirculation of the water per condenser/deaerator/economizer), and to remove saline constituents (per boiler drum blow off) in order to reach acceptable parameters of water. This is pronounced in the case when gases in the drum are recirculated per the downcomer and the waterwall. State of the art solutions do not consider the time needed for steam water cycle purification. This is because the combined start-up time of the steam generator and the steam turbine is longer than the time required for the purification. Furthermore, the use of a degassed conductivity measurement system may allow an earlier release of the steam turbine roll off.

It is therefore needed to solve the problems of the prior art. Specifically, to reduce the time require to transition the steam generator from standstill to the firing mode of operation. Further there is a need to avoid thermal stress of components of the steam generator, especially to avoid thermal stress of critical components of the steam generator. Additionally, there is a need to decrease the environmental impact of starting up of the steam generator by decreasing the use of the auxiliary fuel during startup of the steam generator.

BRIEF DESCRIPTION

The following presents a simplified summary of the disclosed subject matter in order to provide a basic understanding of some aspects of the various embodiments described herein. This summary is not an extensive overview of the various embodiments. It is not intended to exclusively identify key features or essential features of the claimed subject matter set forth in the Claims, nor is it intended as an aid in determining the scope of the claimed subject matter. Its sole purpose is to present some concepts of the disclosure in a streamlined form as a prelude to the more detailed description that is presented later.

The various embodiments of the present invention are directed to reducing the overall "return to service" time of a steam generator, such as a sub-critical steam generator or a super-critical steam generator. The "return to service" times includes transition from a standstill mode of operation to a mode of operation ready to run a steam turbine, with the turbine preferably kept in a warm or hot standby.

The solution provided by the various embodiments involves installation of auxiliary heating devices and providing piping allowing to withdraw or re-direct heated water and installation/upgrades of auxiliary heating devices. The auxiliary heating devices may include, but are not limited to, a sparger operated with steam from an auxiliary boiler, and/or an auxiliary electric heater like immersion heaters or heating blankets. The solution also includes methods of keeping the boiler in standby conditions, and methods of heating up start-up stress critical steam producing or stress critical components within safe temperature rise criteria. Unless stated otherwise, embodiments presented herein can be used with a sub-critical and a super-critical steam generators. Also, it should be noted that features and components included in the presented embodiments can be transferred between the presented embodiments in order to produce further embodiments.

In one embodiment, a system for readying a steam generator includes a first auxiliary heating device, a second auxiliary heating device, a third auxiliary heating device, a fourth auxiliary heating device and/or a fifth auxiliary heating device. The first auxiliary heating device is disposed on a water-steam separator for heating the water-steam separator. The water-steam separator can be a boiler drum. Waterwall tubes are connected to the water-steam separator with furnace top-end piping. The second auxiliary heating device is disposed at least on a part of the furnace top-end piping for heating the furnace top-end piping. The first and the second auxiliary heating devices are heating steam producing components of the steam generator and thus allowing to keep them above the temperature in which materials creating said steam producing components are brittle. The third auxiliary heating device is installed to provide the heat to keep a deaerator at the required condition, in particular when a feedwater startup pump is engaged. The fourth auxiliary heating device is disposed on the economizer for heating the economizer. This allows the economizer to be kept at required for operation conditions and, in particular, prevents the economizer from freezing. Also, this allows the economizer to be kept above the temperature in which materials creating the economizer are brittle. An economizer outlet feedwater line includes the fifth auxiliary heating device which heats or (pre-)heats the water discharged by the economizer. This allows heating or warmkeeping of components of the steam generator that are downstream to the economizer outlet feedwater line.

In one embodiment, a method of servicing of a steam generator is included. The method comprises installing the system for readying the steam generator as defined herein on the steam generator. The steam generator can be a sub-critical steam generator or a super-critical steam generator.

In one embodiment, a method of operation of a steam generator is included. The method of operation includes installing the system for readying the steam generator as defined herein on the steam generator. The steam generator can be a sub-critical steam generator or a super-critical steam generator. The use of a greater number of auxiliary devices ensures that the startup procedure is realized faster. At the same time, a defined order of switching on particular auxiliary devices ensures fast startup procedure while keeping the steam generator energy efficient. In a certain embodiment, starting up of the steam generator includes the following substeps warming a deaerator with a third auxiliary heating device to at least partially degas water contained in the deaerator, and before starting pumping water to an economizer using a feedwater pump. This allows pace starting up of the deaerator and the economizer and thus of the steam generator. This embodiment can also include heating water in an economizer outlet feedwater line with the fifth auxiliary heating device and filling a water-steam separator, e.g., a boiler drum, with the water heated in the economizer outlet feedwater line. The (pre-)heated water separator(s) fills them and is used to flush decontaminated water caught in circulation within the steam generator. The (pre-)heated water entering the boiler drum flows to waterwall tubes via boiler drum downcomer(s) and a waterwall inlet header. In this manner, the feedwater heats up the boiler drum, the boiler drum downcomer, the waterwall inlet header and the waterwall tubes before a furnace is purged, and an auxiliary fuel combustor may be ignited. This embodiment can also include recirculation of water between the boiler drum, the deaerator and the economizer in order to pace the heating and thus to pace starting of the steam generator.

The method of operation may additionally or alternatively include shutting down of the steam generator. In one embodiment, in order to shorten the time needed to start producing steam with the steam generator, the method includes keeping said at least one water-steam separator filled with water and blanketing said at least one water-steam separator with nitrogen or keeping the deaerator bottled up together with the third auxiliary heating device, keeping the economizer bottled up together with the fourth auxiliary heating device, keeping said at least one water-steam separator at least at the temperature in which materials making said at least one water-steam separator are no longer brittle with the first auxiliary heating device, and keeping the furnace top-end piping at least at the temperature in which materials making the furnace top-end piping are no longer brittle with the second auxiliary heating device. Keeping the deaerator and the economizer bottled up includes limiting of gas diffusion into the water stored in the deaerator and the economizer.

In one embodiment fora steam generator, the filling of the steam generator with feedwater, the (pre-)heating of the at least partially degassed feedwater with the fifth auxiliary heating device, the warming of the water-steam separator, e.g., a boiler drum with the first auxiliary heating device, and the auxiliary fuel combustor are controlled based on measurements (e.g., temperature and/or pressure) obtained about the steam generator and the auxiliary heating devices. To this extent, a controller can control the inlet temperature of the water-steam feedwater and the outlet temperature of the waterwall at a safe temperature rise rate and temperature differential of components like the water-steam separator (e.g., boiler drum), the boiler drum downcomer, the waterwall inlet header, and/or the waterwall tubes. As thick-walled components are warm kept at ductile condition, the safe temperature rise rates of the thin-walled downcomer and waterwall are allowed to bring the thin-walled components in short time to ductile conditions. Having all components in ductile condition, the thick-walled components will secure safe temperature rise rate of the steam generator.

In one embodiment of a sub-critical steam generator, water contained in the boiler drum downcomer and the waterwall inlet header can be extracted and recirculated to a condenser that is in fluid communication with the deaerator and the auxiliary heating source. After filling the boiler drum, the boiler drum downcomer, the waterwall inlet header and the waterwall tubes, the extraction line will be opened to recirculate the cooled down and gas contaminated water back to the condenser, while the drum is continued to be filled with degassed and heated feedwater.

In one embodiment of a sub-critical steam generator, once the heat up process reaches the boiling point inside the drum, boiler drum vent valves are closed, and the evaporated steam is used to blow off the air steam mixture trapped in the boiler drum and superheater. The contaminated water in the waterwall is either discharged or recircled.

In one embodiment of a sub-critical steam generator, the natural circulation in the waterwall will set in with the release of the firing of the auxiliary fuel combustor. With the natural circulation in place, the gas contaminated water of the waterwall will be hotter than the filling water of the economizer, such that it covers the water surface of the drum, while the degassed water preferentially sinks down and builds the flow within the downcomer. This way, the contaminated water within the downcomer, waterwall and its headers may be quickly replaced by degassed water.

In one embodiment for a super-critical steam generator, the filling of the steam generator with feedwater, the (pre-) heating of the at least partially degassed feedwater with the second auxiliary heating device, the warming of the water-steam separator with the first auxiliary heating device, the mass flow of the boiler circulation pump, and the auxiliary fuel combustor are controlled based on temperature measurements obtained about the steam generator and the heating device. To this extent, the controller can control the inlet temperature of the separator feedwater and the outlet temperature of the waterwall at a safe temperature rise rate and temperature differential of components like the separator, the waterwall inlet header, or the waterwall tubes. As thick-walled components are warm kept at ductile condition, the safe temperature rise rates of the thin-walled components like the waterwall are allowed to bring in short time all components to ductile conditions. Having all components in ductile condition, the thick-walled components will secure safe temperature rise rate.

Combining the use of at least one auxiliary heating device with recirculation of the water will help to pass the critical temperature of flow accelerated corrosion faster and at a significantly lower level of dissolved oxygen. In this manner, the steam generator in a ductile standby mode can transition faster from pre-operational readying of the steam generator (i.e., filling of water) to a light-off of the primary fuel combustors. As a result, the need to reheat these components per auxiliary fuel, which is often the case because of the safe temperature rise or water chemistry conditions, is reduced to its minimum, and thus time and expenses can be reduced for the utility. In particular, this is achieved by actively deaerating the feedwater with the third auxiliary heating device while elevating the feedwater temperature with the fifth auxiliary heating device, and warming the boiler drum/water-steam separator(s) with the first and the second auxiliary heating devices to heat up the steam producing components of the steam generator, along with the recirculation of the water to the condenser (for a sub-critical unit which includes circulation between the water-steam separator/the boiler drum, the deaerator and the economizer) or to a recirculation circuit (for a super-critical unit which includes circulation between the water-steam separator(s) and the economizer).

DRAWINGS

The present invention will be better understood from reading the following description of non-limiting embodiments, with reference to the attached drawings, wherein below:

DETAILED DESCRIPTION

Figure 1:
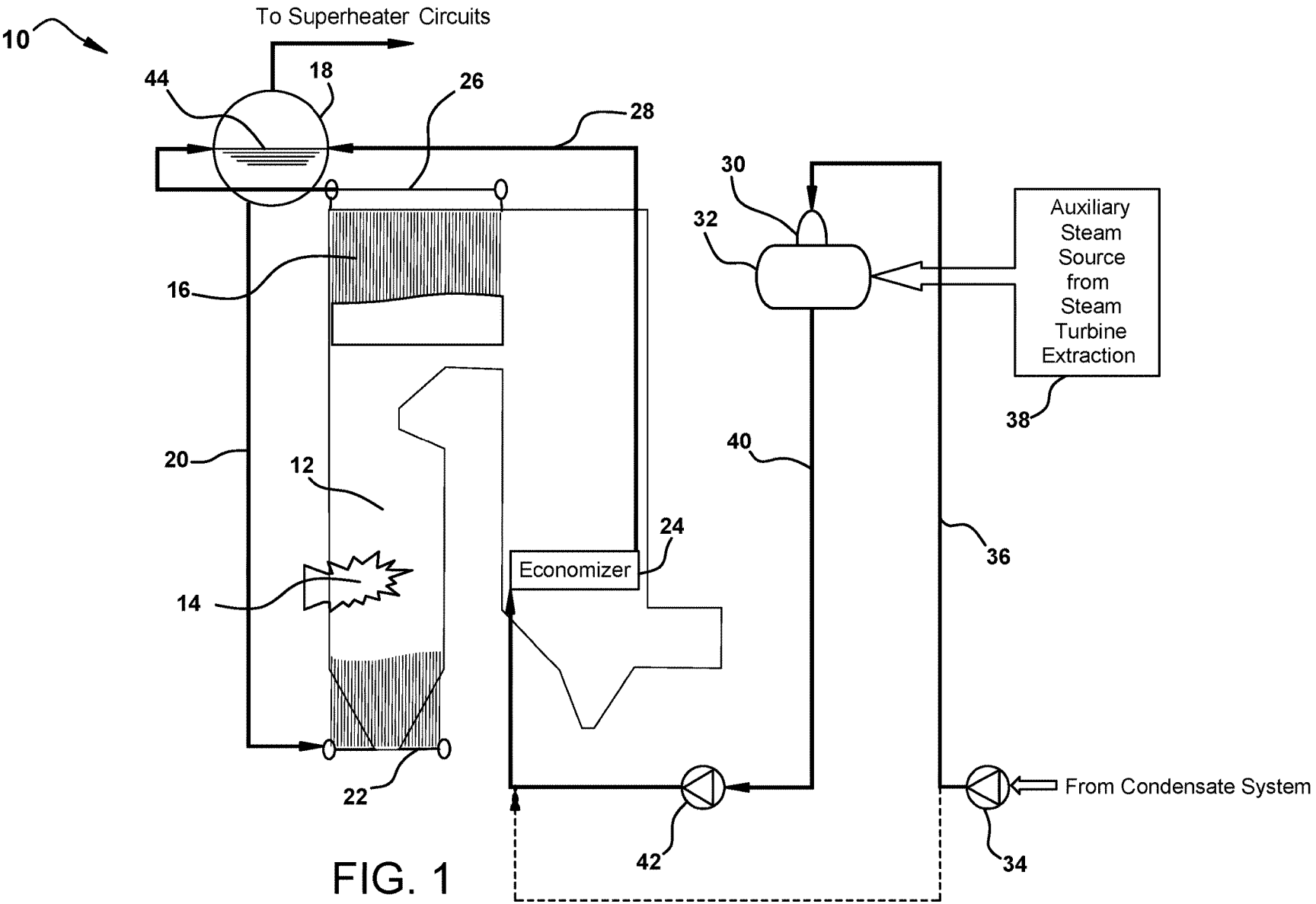
FIG. 1 shows a schematic of a sub-critical steam generator according to the prior art.

Example embodiments of the present invention will be described more fully hereinafter with reference to the accompanying drawings, in which some, but not all embodiments are shown. Indeed, the present invention may be embodied in many different forms and should not be construed as limited to the embodiments set forth herein; rather, these embodiments are provided so that this disclosure will satisfy applicable legal requirements. For like numbers may refer to like elements throughout.

This disclosure relates generally to at least partially degassed and (pre-)heated water filling for a fast start-up of a steam generator that is in a standstill mode of operation in which the steam generator is not fired and the waterwall is emptied. In this disclosure, in some embodiments, preheated water is a water preheated before filing, whereas heated water is a water heated during filing. In other embodiments, these terms are used interchangeably. The disclosure is mainly described with respect to a sub-critical steam generator and a super-critical steam generator. However, it is understood that the system and method of the various embodiments for readying a sub-critical steam generator and a super-critical steam generator with degassed and (pre-) heated water filling for a fast start-up may have applicability to other types of steam generators. Nonetheless, as used herein, "warmkeeping" (known also as "boxing-up") of a steam generator means maintaining components of the steam generator at an elevated temperature while in the standstill mode of operation in an unfired condition, while "warming" of components is the heat up of components by use of hot water, opposed to "heating" of components achieved in a fired condition, while "degassed water" or "degassed feedwater" means steam generator feedwater that has a reduced content of oxygen (e.g., less than 8-10 mg/l) and other dissolved gases such as carbon dioxide and nitrogen. In this context, "degassed" can mean "at least partially degassed". As used herein, "upstream" and "downstream" are terms that indicate a direction relative to the flow of a fluid.

To this extent, the warmkeeping, the degassed water filling, and the warming according to the various embodiments described herein can place the sub-critical steam generator or the super-critical steam generator in a more favorable start-up condition that allows the steam generator to transition from the standstill mode of operation to the firing mode of operation without delay in a manner that avoids delays due to brittleness of stress critical steam producing components or stress critical components and other adverse conditions that can lead to excessive thermal stresses when the steam generator is lit off. As a result, the steam generator (e.g., the sub-critical steam generator or the super-critical steam generator) will be more responsive to sudden electrical grid demands.

The warmkeeping and at least partially degassed water filling aspects of the various embodiments that facilitate a fast start-up of either a sub-critical steam generator or a super-critical steam generator without excessive thermal stressing of the steam components is achieved by introducing a heat injection point directly at a location of entry of the fill feedwater to a stress critical steam producing component or a stress critical component of the steam generator to control the fill water temperature in direct relation to the allowable temperature limit of the critical steam components. As used herein, a "stress critical steam producing component" or a "stress critical component" means a component of a sub-critical steam generator or the super-critical steam generator that has masses of metal which need to be heated up within safe temperature rise criteria to minimize brittleness conditions and excessive thermal stresses. In one embodiment, the stress critical steam producing components of a sub-critical steam generator can include, but are not limited to, the boiler drum and the waterwall tubes. Other stress critical steam producing components can include the boiler drum downcomer and/or the waterwall inlet header. In one embodiment, the stress critical steam producing components of a super-critical steam generator can include, but are not limited to, a water-steam separator(s), the waterwall tubes, a downcomer(s) and/or the waterwall inlet header. As used herein, the term "in fluid communication" means that there is a passage that allows a fluid to flow. A skilled person understands that connections between elements in any steam generator require to have a passage allowing a fluid to flow and, hence, this fact will not be emphasized in this disclosure.

In one embodiment, a plurality of auxiliary heating devices can be utilized to warm the stress critical steam producing components and/or (pre-)heat at least partially degassed feedwater flowing to or from the components during the filling of the water fill circuits. The water fill circuits include the economizer, the water-steam separator (which can be the boiler drum), and the furnace. This allows the temperature of the feedwater to be controlled in a manner that conforms to the allowable temperature limit specified for the stress critical steam producing components. This keeps the stress critical steam producing components out of a brittleness condition or other conditions that can lead to excessive thermal stresses during light off of the steam generator.

The various embodiments can also entail providing the steam generator with an excess water discharge line that can be used to recirculate back into the steam generator for warmkeeping and continuously refilling of the steam generator with preheated and at least partially degassed feedwater. For example, the excess water discharge line can connect to a steam turbine condenser. The condenser can supply the excess water received from the excess water discharge line to a deaerator to facilitate the reduction of the gas content in the feedwater that is supplied to the economizer of the steam generator.

Further information of the various embodiments is described below in more detail. A comparative prior art example is also provided.

Comparative Prior Art Example

Turning now to FIG. 1, this figure presents a schematic of a sub-critical steam generator 10 according to the prior art that produces steam that can be used for power generation or heating purposes. This example introduces a description of various elements of a steam generator which are relevant for the invention. Also, this example illustrates some of the drawbacks of the prior art solutions.

As shown in FIG. 1, the sub-critical steam generator 10 includes a furnace 12 that burns a mixture 14 of fuel and air provided to the furnace. The fuel, which can be a pulverized solid fuel, such as coal, is provided to the furnace by a pulverizer (not shown). While pulverized coal is mainly used as fuel, the furnace 12 can be designed to enable mixed combustion of oil, biomass or a by-product gas. The air can be provided to the furnace 12 via an air source (not shown). The mixture 14 of fuel and air burns in a combustion chamber of the furnace 12. The combustion of the fuel and air creates thermal energy or heat, which is used to heat a liquid, such as water, in furnace waterwall tubes 16 that line the walls of the furnace 12, of which these tubes can also be referred to as an evaporator part of the furnace 12. The heating of the water in the furnace waterwall tubes 16 creates saturated water which is separated into water and steam in a boiler drum 18. The steam generated in the sub-critical steam generator 10 may be made to flow to a steam turbine (not shown) to generate electricity or provide heat for other purposes.

Other components of the sub-critical steam generator 10 include one or more boiler drum downcomers 20 (herein the boiler drum downcomer), an inlet header or headers 22 (herein the inlet header) to the furnace waterwall tubes 16, and an economizer 24. The boiler drum 18 is a reservoir of water/steam at the top-end of the furnace waterwall tubes 16. In addition to receiving a steam and water mixture from the top end of the furnace waterwall tubes 16 via furnace top-end piping 26, the boiler drum 18 can receive water from feedwater supplied to the economizer 24 via economizer outlet feedwater piping 28. The feedwater supplied to the economizer 24 comes from a deaerator heating system 30 (the deaerator) that includes an inventory tank 32 of water obtained from a condensate system via a condensate pump 34 and condensate piping 36, an auxiliary steam source 38 to heat the inventory tank 32, and feedwater supply piping 40 or line 40 that supplies heated deaerated feedwater to the economizer 24 via a feedwater pump 42. It is understood that the sub-critical steam generator 10 can have other components that are not discussed herein for purposes of brevity. A non-exhaustive list of these components can include a superheater and/or a reheater.

The furnace waterwall tubes 16, the boiler drum 18, the boiler drum downcomer 20, the inlet header 22, the economizer 24, the furnace top-end piping 26, the economizer outlet feedwater piping 28, the feedwater supply piping 40, the feedwater pump 42, as well as the deaerator 30 and the components of the condensate system (e.g., the condensate pump 34 and the condensate piping 36) are components that can form parts of the various water fill circuits of the sub-critical steam generator 10. In these water fill circuits, water comes into the boiler drum 18 from the economizer 24 and the economizer outlet feedwater piping 28. The water that comes into the boiler drum 18 will go to the inlet header 22 for supply to the furnace waterwall tubes 16 at the bottom end of the furnace 12. The water entering the bottom of the furnace 12 at the furnace waterwall tubes 16 raises upwards along the tubes lining the furnace walls. The combustion of the mixture 14 of fuel and air heats the water in the furnace waterwall tubes 16 into a steam and water mixture. The boiler drum 18 receives the steam and water mixture from the furnace waterwall tubes 16 through the furnace top end piping 26 and will separate the saturated steam from the water and steam mixture in the drum. In this manner, the sub-critical steam generator 10 can provide the saturated steam to other parts in the steam generator for further heating and ultimately to a steam turbine to generate electricity or provide heat for other purposes. The water is mixed with the replenishing incoming feedwater from the economizer outlet feedwater piping 28 in the boiler drum 18 and through natural circulation is supplied to the boiler drum downcomer 20 and furnace waterwall tubes 16 within the furnace 12. The water in the furnace waterwall tubes 16 can then be fed back to the boiler drum 18 for further steam generation.

As noted above, sub-critical steam generators, like sub-critical steam generator 10, are slow to transition from an unfired standstill mode of operation to a firing mode of operation upon a demand to return to service. For example, readying the sub-critical steam generator 10 starts with filling the economizer 24, the boiler drum 18, and the furnace waterwall tubes 16 with pre-cycle cleaned water that comes from the deaerator 30 and the condensate system. Although not shown in FIG. 1, the condensate system can include a condenser that cools exhaust steam from a turbine, collects the latent heat of the steam, and condenses the steam into water. The condensate pump 34 can pressurize the condensed water for supply to the deaerator 30 via the condensate piping 36.

The inventory tank 32 of the deaerator 30 can receive the condensed water from the condensate piping 36, or alternatively as shown by the dotted line in FIG. 1, the piping 36 can supply the condensed water to the economizer bypassing the deaerator. The inventory tank 32 can include a tank combination including a feedwater storage tank and a connected deaerator tank. In general, the purpose of this tank combination is to store and deaerate the water into at least partially degassed feedwater through pre-warming the water inventory before it is fed to the economizer 24 of the sub-critical steam generator 10. Pre-warming the water in the inventory tank 32 is accomplished by the auxiliary steam source 38, which can be an external heat source. This pre-warming of the water in the inventory tank 32 can occur while the sub-critical steam generator 10 is not in service.

This pre-warmed or (pre-)heated water is then forwarded from the inventory tank 32 as heated deaerated feedwater (i.e., at least partially degassed feedwater) into a tube bank section of the economizer 24 of the sub-critical steam generator 10 via the feedwater supply piping 40 and the feedwater pump 42. The feedwater passes through the economizer 24 to fill the boiler drum 18 via the economizer outlet feedwater piping 28. As the water reaches the boiler drum 18, the boiler drum downcomer 20 will fill up as well. This builds a fill connection to the furnace waterwall tubes 16 via the inlet header 22. As more water is fed through the economizer 24, the furnace waterwall tubes 16 will fill to the roof level or top-end of the furnace 12. This allows the boiler drum level to rise to a start-up level that is near or slightly below a boiler drum centerline 44.

At this time the pre-operational filling part of the readying process of the sub-critical steam generator 10 is complete. With the pre-operational filling part complete, the readying process of the sub-critical steam generator 10 can continue with igniting a fire in the furnace 12 to further heat the water and to start production of steam.

If the sub-critical steam generator 10 is subject to the pre-operational filling part of the readying process of the sub-critical steam generator 10, the temperature decays in components that include metal and that are receiving water, e.g., the boiler drum 18, the boiler drum downcomer 20, the inlet header 22, and the furnace waterwall tubes 16. Consequently, the pre-operational filling decreases the temperature of the components which produces e.g., the above-mentioned problems with materials of the components becoming brittle. As the result, the pre-operational filling makes the transition from the standstill to the firing mode of operation detrimental to design lifetime and/or operational margins of these components. The resulting increase in tube metal temperature can lead to tube stress associated with thermal shock when the sub-critical steam generator 10 is lit off. This exacerbates the time and expenses that utility boiler power plants incur during the transition from standstill to the firing mode.

Figure 2:
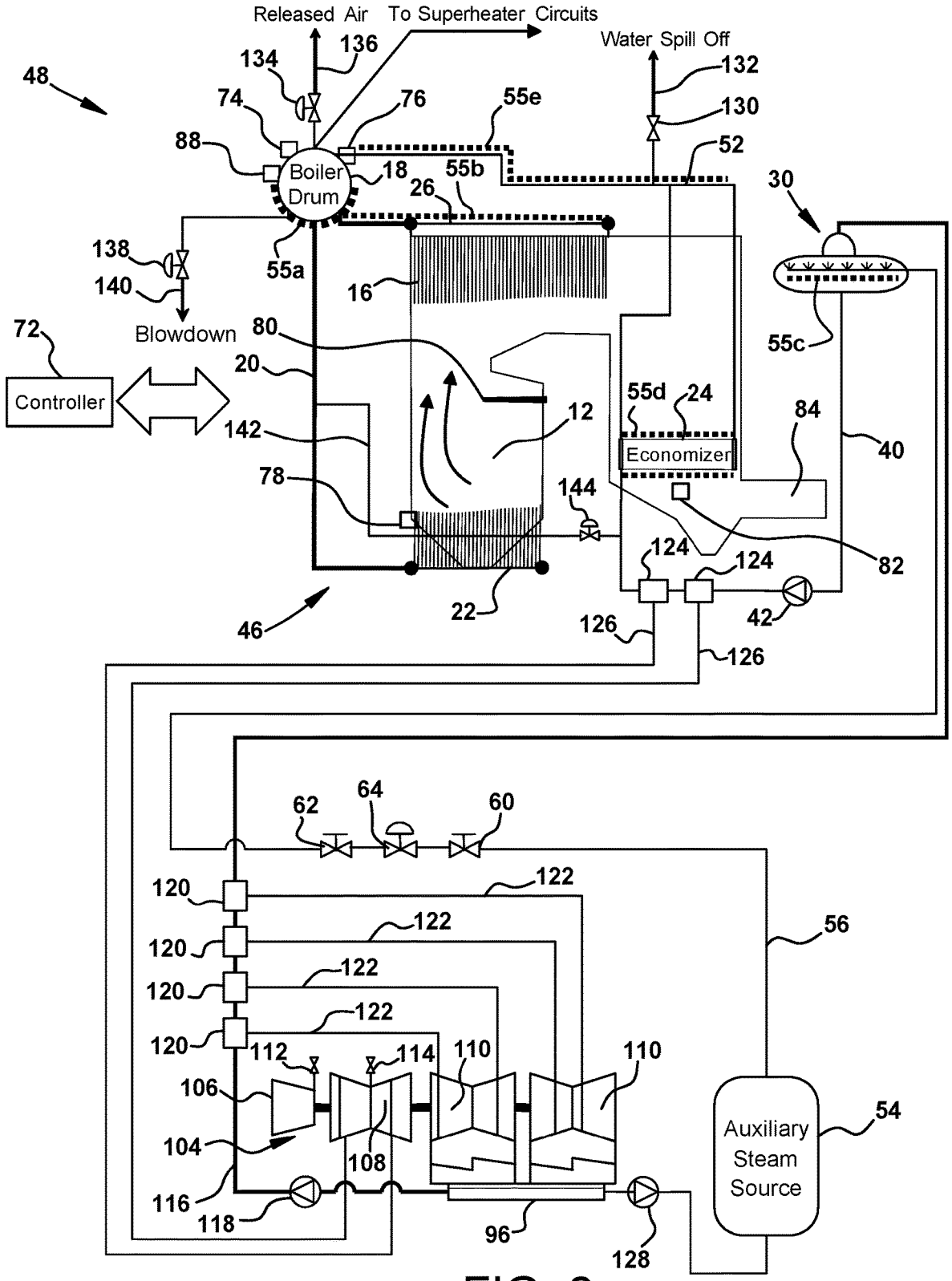
FIG. 2 shows a schematic of a system for readying a sub-critical steam generator for a fast start-up according to an embodiment of the invention.

FIG. 2 shows a schematic of a system 46 for readying a sub-critical steam generator 48 with warmkeeping and, optionally, at least partially degassed water filling to place the steam generator in a more favorable start-up condition that facilitates a fast start-up without subjecting the stress critical steam producing components to a brittleness condition and other adverse conditions that can lead to excessive thermal stresses when the steam generator is lit off.

In one embodiment, the system 46 comprises a sub-critical steam generator comprising a boiler drum 18 and a furnace 12, an economizer 24, an inlet header 22 and waterwall tubes 16. The economizer 24 is connected to the boiler drum 18 by economizer outlet feedwater piping 52. The waterwall tubes 16 are connected to the boiler drum 18 with furnace top-end piping 26. The inlet header 22 is connected with the boiler drum 18 with a boiler drum downcomer 20.

As shown in FIG. 2, the system 46 can include a heating system 30, such as for example, a deaerator (hereinafter the "deaerator 30") to provide at least partially degassed feedwater to the economizer 24 via the feedwater supply piping 40 and feedwater pump 42. It is understood that although the deaerator 30 depicted in FIG. 2 and FIGS. 3, 5 and 6 disclose a steam injection lance, other heating elements can be implemented for use in the deaerator 30 to facilitate the various embodiments described herein.

The system 46 can include one, two, three, four, five or more (plurality) auxiliary heating devices 55*a-e* which are used for warming the stress critical steam producing components and/or (pre-)heating the at least partially degassed feedwater flowing to or from the components of the steam generator during the filling of the water fill circuits. As shown in FIG. 2, a first auxiliary heating device 55*a* can be disposed on the boiler drum 18 and a second auxiliary heating device 55*b* can be disposed on the furnace top-end piping 26 (i.e., the waterwall outlet header). A fifth auxiliary heating device 55*e* (pre-)heats (e.g., the at least partially degassed feedwater) water discharged by the economizer 24 before an inlet of the boiler drum 18 (e.g., at an economizer outlet feedwater line 52). A third auxiliary heating device 55*c* can be configured to provide heat to the deaerator 30 to keep the deaerator at the required condition at mass flows as provided by the feedwater pump 42. A fourth auxiliary heating device 55*d* can be disposed about the economizer 24 to protect the economizer from temperature stress or even from freezing.

The plurality of auxiliary heating devices 55*a-e* can include any of a number of heating devices. For example, each of the auxiliary heating devices 55*a-e* can include, but is not limited to, a sparger operated with steam from an auxiliary boiler, and/or an auxiliary electric heater, like immersion heaters or heating blankets. In one embodiment, as shown in FIG. 2, the aforementioned third auxiliary heating device to provide heat to the deaerator 30 can include an auxiliary steam source 54, said auxiliary steam source 54 can also be referred to herein as an auxiliary heating source 54.

With the system 46 for readying the sub-critical steam generator 48, the following methods can be applied.

For example, during shutdown of the sub-critical steam generator 48, the boiler drum 18 is kept filled with water and blanketed with nitrogen, and/or the deaerator 30 is bottled up together with the third auxiliary heating device and/or the economizer 24 is bottled up together with the fourth auxiliary heating device, such that the gas diffusion is limited to the water-air interface while the bottled water remains degassed. Additionally or optionally, the boiler drum 18 and the waterwall outlet header are kept warm above its brittleness condition per the first and the second auxiliary heating devices. Blanketing with nitrogen can involve a separate valving arrangement (not shown in the figures). For this arrangement, a possible source of nitrogen can include a bottle rack of steel cylinders having compressed nitrogen gas. Typically, blanketing is done using spill off or air vent lines.

On start-up of the sub-critical steam generator 48, the deaerator 30 can be heated up to operation condition with the third auxiliary heating device 55*c* to reduce the dissolved gas before the feedwater pump 42 is started and begins to subject the feedwater to the economizer 24. Said operation conditions include bringing water at the atmospheric condition to 100° C. (212° F.) and, optionally, pressurizing the deaerator 30. The fifth auxiliary heating device 55*e* can be used to (pre-)heat the discharged (e.g., degassed) feedwater exhausted from the economizer 24 before filling it into the boiler drum 18. The (pre-)heated water entering the boiler drum 18 will flow to the waterwall tubes 16 via the boiler drum downcomer 20 and the waterwall inlet header 22. In this manner, the feedwater heats up the boiler drum 18, the boiler drum downcomer 20, the waterwall inlet header 22 and the waterwall tubes 16 before the furnace 12 is purged, and an auxiliary fuel combustor may be ignited.

In one embodiment, the filling of the sub-critical steam generator 48 with feedwater, the (pre-)heating of the (e.g., at least partially degassed) feedwater with the fifth auxiliary heating device 55*e*, the warming of the boiler drum 18 wall with the first auxiliary heating device 55*a*, and the auxiliary fuel combustor are controlled by a controller 72 based on temperature measurements obtained about the steam generator and the auxiliary heating devices. To this extent, the controller 72 can control the inlet temperature of the drum feedwater and the outlet temperature of the waterwall at a safe temperature rise rate and temperature differential of components like the boiler drum 18, the boiler drum downcomer 20, the waterwall inlet header 22, or the waterwall tubes 16. As thick-walled components are warm kept at ductile condition, the safe temperature rise rates of the thin-walled downcomer 20 and waterwall tubes 16 are allowed to bring the thin-walled components in short time to ductile conditions. Having all components in ductile condition, the thick-walled components will limit safe temperature rise rate.

In one embodiment, water contained in the boiler drum downcomer 20 and the waterwall inlet header 22 can be extracted and recirculated to a condenser 96 that is in fluid communication with the deaerator 30 and the auxiliary heating source 54. After filling the boiler drum 18, the boiler drum downcomer 20, the waterwall inlet header 22 and the waterwall tubes 16, an extraction line, which is depicted in FIG. 3 (reference element 90), can be opened to recirculate the cooled down and gas contaminated water back to the condenser 96, while the drum is continued to be filled with degassed and heated feedwater.

In one embodiment, once the heat up process reaches the boiling point inside the boiler drum 18, boiler drum vent valve(s) 134 can be closed, and the evaporated steam can be used to blow off the air steam mixture trapped in the boiler drum and a superheater (not shown). The contaminated water in the waterwall tubes 16 can then either be discharged or recircled. For example, the contaminated water in the waterwall tubes 16 can be discharged via a discharge line or recircled via a recirculation line like that shown in FIG. 3 (discharge line 94 and return line 90).

In one embodiment, the natural circulation in the waterwall will set in with the release of the firing of the auxiliary fuel combustor. With the natural circulation in place, the gas contaminated water of the waterwall will be hotter than the filling water of the economizer 24, such that it covers the water surface of the boiler drum 18, while the degassed water preferentially sinks down and builds the flow within the downcomer 20. This way, the contaminated water within the downcomer 20, waterwall and its headers may be quickly replaced by degassed water.

Figure 3:
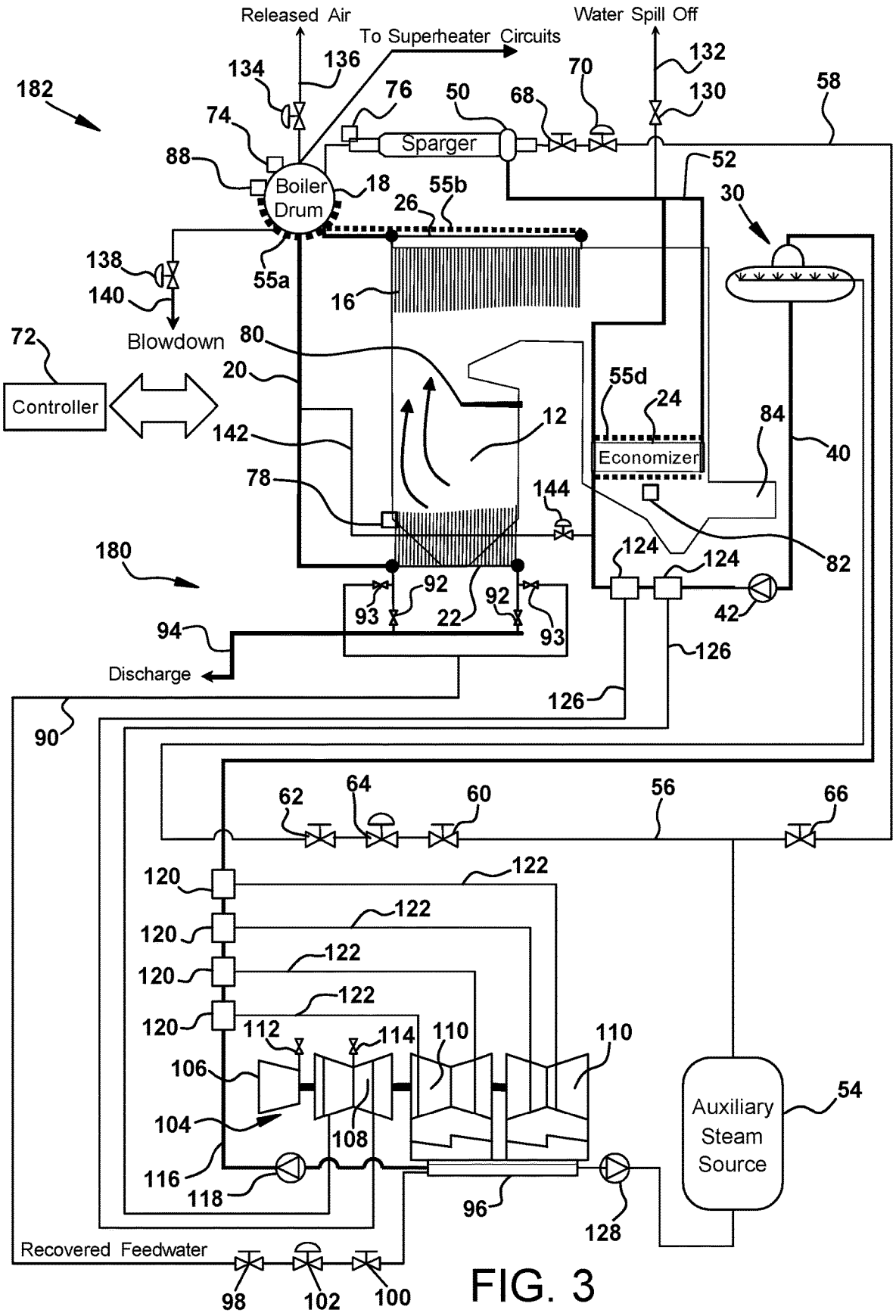
FIG. 3 shows a schematic of a system for readying a sub-critical steam generator for a fast start-up according to another embodiment of the invention.

FIG. 3 shows a schematic of a system 180 for readying a sub-critical steam generator 182 for a fast start-up according to another embodiment of the invention. In this embodiment, a sparger 50 is used as the fifth auxiliary heating device (55*e*) to (pre-)heat the at least partially degassed feedwater water discharged by the economizer 24 before the inlet of the boiler drum 18. As shown in FIG. 3, the sparger 50 can be in fluid communication with the economizer 24 and the boiler drum 18 to warm the at least partially degassed feedwater flowing from the economizer 24 to the boiler drum 18 via the economizer outlet feedwater line 52.

With the sparger 50 in this location, the at least partially degassed feedwater can be warmed before entering the boiler drum 18, which in turn will heat the boiler drum, the boiler drum downcomer 20, the waterwall inlet header 22 and the waterwall tubes 16. This eliminates the loss of heat with the at least partially degassed feedwater that would typically occur with the sub-critical steam generator 10 of FIG. 1 as the feedwater moves from the deaerator 30 through the economizer 24, then to the boiler drum 18 and onto fill the waterwall tubes 16 via the boiler drum downcomer 20 and the waterwall inlet header 22. Also, the use of the sparger 50 in this manner can bring heavy wall components such as the boiler drum 18 out of a brittleness condition and in a high temperature range flexibility window.

Figure 5:
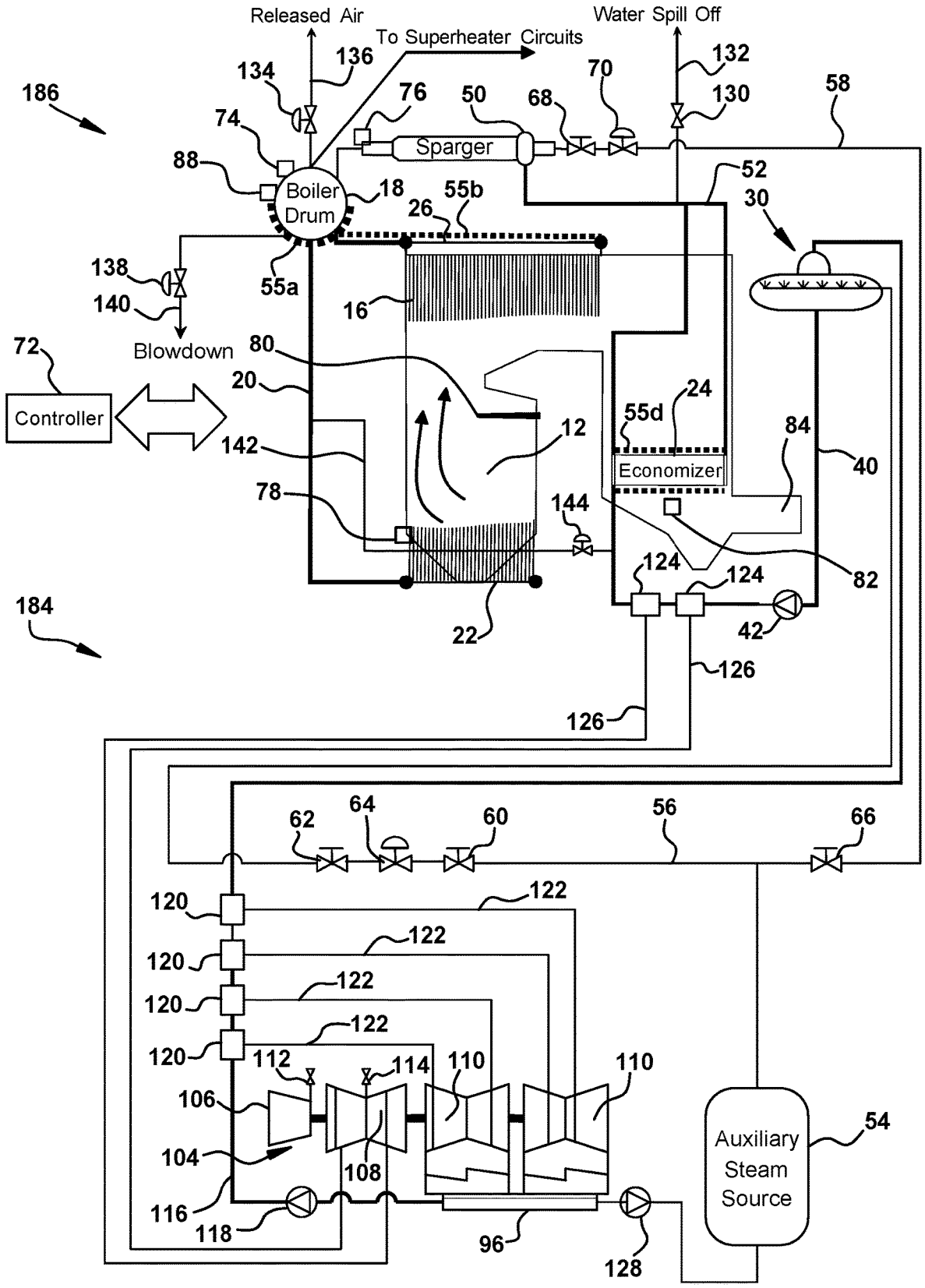
FIG. 5 shows a schematic of a system for readying a sub-critical steam generator for a fast start-up that is an alternative embodiment to the system depicted in FIG. 3.

Although the embodiment depicted in FIG. 3, and the one shown in FIG. 5, use a sparger to (pre-)heat the water discharged by the economizer 24 before the inlet of the boiler drum 18, it is understood that the sparger 50 represents only one type of heating element that can be used to pre-warm the water discharged by the economizer 24. Other types of heating elements such as for example, an electric heater like immersion heaters or heating blankets, can be used in place of the sparger in these embodiments. For example, as discussed above in this disclosure, FIG. 2 shows an embodiment in which auxiliary heating devices 55*e* and 55*a* are deployed on the economizer outlet feedwater line 52 and the boiler drum 18, respectively, and used in lieu of a sparger to preheat the water discharged from the economizer 24. Accordingly, the embodiments described in FIGS. 3 and 5 that use a sparger to preheat the water discharged from the economizer 24 are only illustrative of one type of heating element that can be deployed and is not meant to be limiting to these embodiments, as well as to other embodiments.

Figure 6:
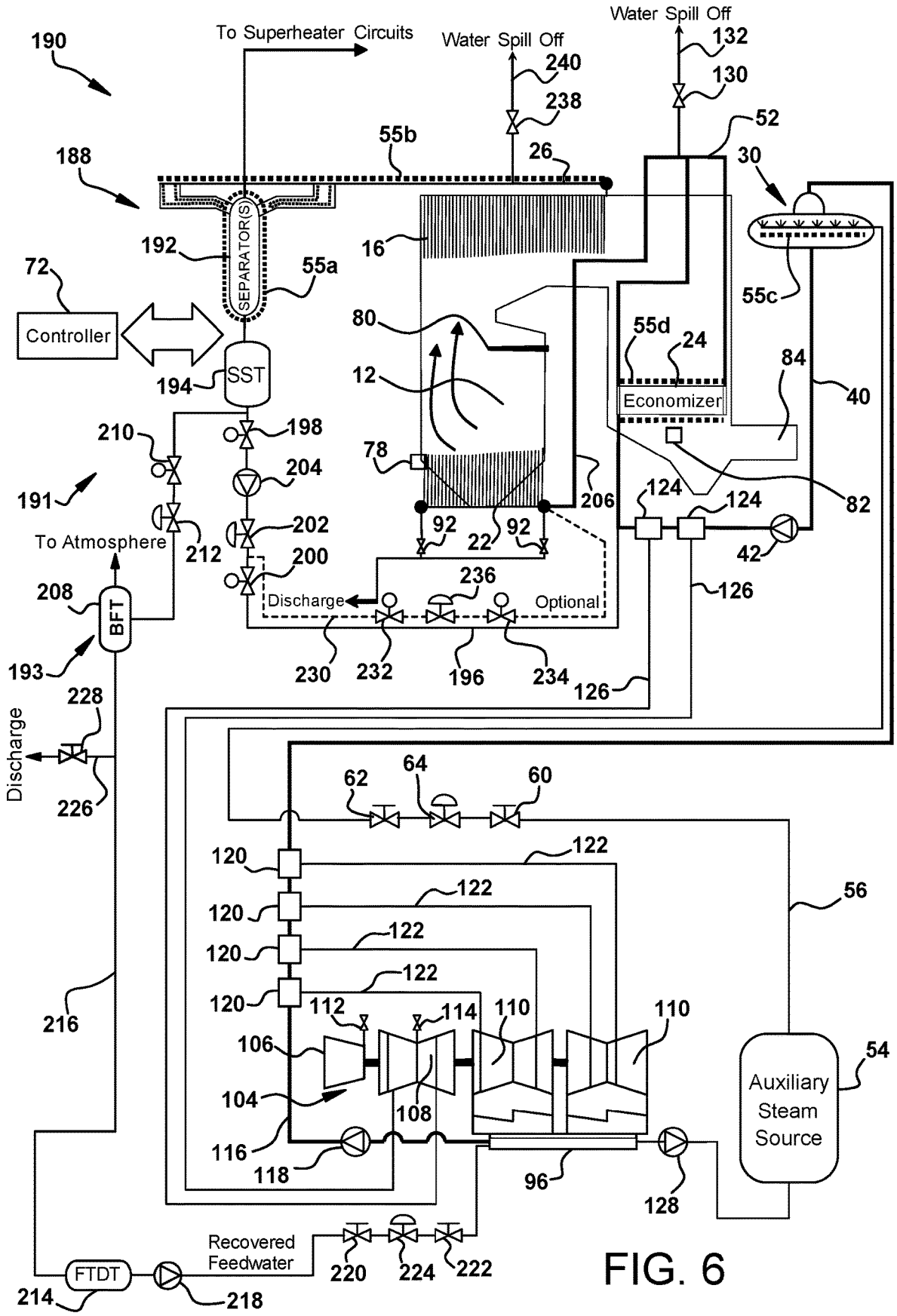
FIG. 6 shows a schematic of a system for readying a super-critical steam generator for fast start-up according to an embodiment of the invention.

The loss of heat that can typically occur with the approach described in FIG. 1 is represented in FIG. 3 and other figures such as FIGS. 5 and 6 by the arrows overlaying the waterwall tubes 16. This loss of heat is obviated in this embodiment by the boost provided by the sparger 50 to the at least partially degassed feedwater which heats up the steam producing components in the sub-critical steam generator 182 such as the boiler drum 18, the boiler drum downcomer 20, the waterwall inlet header 22 and the waterwall tubes 16.

To facilitate the active deaerating by the deaerator 30 that produces the at least partially degassed feedwater and the warming of temperature critical components of the sub-critical steam generator 182 by the sparger 50, an auxiliary heating source 54 can be placed in fluid communication with the deaerator 30 and the sparger 50 to heat the deaerator and, via the sparger 50, the temperature critical components. In one embodiment, as shown in FIG. 3, the auxiliary heating source 54 can include an auxiliary steam source. In this configuration, the auxiliary steam source 54 can supply steam to the deaerator 30 via a deaerator warming supply line 56 and steam to the sparger 50 via a boiler drum warming supply line 58. Since the sparger 50 heats circulating water and the deaerator 30 degasses water, their combined use accelerates readiness of the steam generator to firing conditions. Although FIG. 3 shows only one auxiliary steam source, it is understood that more than one steam source can be utilized.

The deaerator warming supply line 56 which can be in fluid communication with the auxiliary steam source 54 and the deaerator 30, supplies steam from the auxiliary steam source 54 to the deaerator 30. In this manner, the deaerator 30 can warm the at least partially degassed feedwater generated in the deaerator before delivering to the economizer 24 via the feedwater supply piping 40 and the feedwater pump 42.

In one embodiment, the deaerator warming supply line 56 comprises a deaerator warming supply line isolation and control valve assembly to control the flow of the steam from the auxiliary steam source 54 to the deaerator 30. For example, the deaerator warming supply line isolation and control valve assembly as shown in FIG. 3 can include a first isolation valve 60, a second isolation valve 62, and a flow control valve 64 separating the first isolation valve 60 from the second isolation valve 62. The first isolation valve 60 is in fluid communication with the auxiliary steam source 54, the second isolation valve 62 is in fluid communication with the deaerator 30, and the flow control valve 64 can control a flow of the supply of steam from the auxiliary steam source 54 to the deaerator 30 via the deaerator warming supply line 56 when the first and second isolation valves are in an opened state.

The boiler drum warming supply line 58 which can be in fluid communication with the auxiliary steam source 54 and the sparger 50, supplies steam from the auxiliary steam source 54 to the sparger 50. To this extent, the sparger 50 will warm the at least partially degassed feedwater in the economizer outlet feedwater line 52 before delivering to the boiler drum 18.

In one embodiment, the boiler drum warming supply line 58 comprises a boiler drum warming supply line isolation and control valve assembly to control the flow of the steam from the auxiliary steam source 54 to the sparger 50. For example, the drum warming supply line isolation and control valve assembly as shown in FIG. 3 can include a first isolation valve 66, a second isolation valve 68, and a flow control valve 70 separating the first isolation valve from the second isolation valve. The first isolation valve 66 is in fluid communication with the auxiliary steam source 54, the second isolation valve 68 is in fluid communication with the sparger 50, and the flow control valve 70 can control a flow of the supply of steam from the auxiliary steam source 54 to the sparger 50 via the boiler drum warming supply line 58 when the first and second isolation valves are in an opened state.

The system 180 of FIG. 3 can further include a controller 72 operatively coupled to the sub-critical steam generator 182, the deaerator 30, the sparger 50 and the auxiliary steam source 54. In one embodiment, the controller 72 can control the filling of the sub-critical steam generator 182 with the at least partially degassed feedwater, and the supply of steam from the auxiliary steam source 54 to the deaerator 30 and the sparger 50, as a function of a plurality of temperature and, optionally, pressure measurements obtained about the steam generator 182 and the sparger 50. In particular, the controller 72 can control the supply of steam from the auxiliary steam source 54 to the deaerator 30 and the sparger 50 to warm the at least partially degassed feedwater in a manner that heats the boiler drum 18, the boiler drum downcomer 20, the waterwall inlet header 22, and the waterwall tubes 16 at a predetermined gradient temperature rise level, keeping the operation of the sub-critical steam generator out of a brittleness condition that leads to embrittlement of these steam producing components, as well as out of excessive thermal stress conditions that are harmful to the components.

The temperature and pressure measurements used by the controller 72 to control the filling of the sub-critical steam generator 182 with the at least partially degassed feedwater and the supply of steam from the auxiliary steam source 54 to the deaerator 30 and the sparger 50 can be obtained by a plurality of temperature and pressure sensors located about the steam generator. Examples of the sensors that can obtain the temperature and pressure measurements and provide the measurements to the controller 72 are shown in FIG. 3. In particular, a boiler drum temperature sensor 74 can obtain the temperature about an outside wall of the boiler drum 18. A sparger temperature sensor 76 can obtain the temperature of the at least partially degassed feedwater discharged from the sparger 50. A waterwall temperature sensor 78 can obtain the temperature of the furnace waterwall tubes 16. A furnace exit gas temperature sensor 80 can obtain the exhaust gas temperature in the furnace 12. An air draft temperature sensor 82 can obtain air draft temperature in a flue gas duct 84 of the sub-critical steam generator 182. A boiler drum pressure sensor 88 can obtain the pressure of the boiler drum 18. Details of how the controller 72 can use these measurements to control the supply of steam from the auxiliary steam source 54 to the deaerator 30 and the sparger 50 to warm the at least partially degassed feedwater via the various valving disclosed herein are discussed below.

The above listing of temperature and pressure sensors is not meant to be exhaustive as it is contemplated that other sensors can be utilized. For example, temperature sensors can be located about one or more of the boiler drum downcomer 20, the inlet header 22, the economizer 24, the deaerator 30, and various piping and lines disclosed herein. In addition to temperature sensors, other types of sensors that are in communication with the controller 72 can be deployed to detect any of a number of conditions. For example, a non-limiting list of other sensors that may be suitable for use with the system 180 and the sub-critical steam generator 182 can include additional pressure sensors, flow sensors, and humidity sensors.

The warmkeeping aspect of the system 180 can be facilitated by extracting degassed feedwater that is to be supplied to the waterwall tubes 16 and forwarding the extracted feedwater for recovery and recirculation back to the deaerator 30 and subsequently to the economizer 24 of the sub-critical steam generator 182, as well as to the auxiliary steam source 54 for reheating the deaerator 30 and/or the sparger 50. As shown in FIG. 3, a boiler drum warming return line 90 can extract water from one or more of the boiler drum downcomer 20 and the waterwall inlet header 22. In one embodiment, the excess water from the boiler drum downcomer 20 and the waterwall inlet header 22 can be obtained via a corresponding pair of isolation valves 93. In particular, the pair of isolation valves 93 can be controlled to permit the excess at least partially degassed feedwater in the boiler drum downcomer 20 and the waterwall inlet header 22 to flow to the boiler drum warming return line 90 for recovery and recirculation. Alternatively, if it is not desirable to use the degassed feedwater for recovery and recirculation, then the isolation valves 92 can be controlled to permit the excess feedwater to be discharged through a discharge line 94.

FIG. 3 shows that the condenser 96 can receive the recovered at least partially degassed feedwater in the boiler drum warming return line 90. In particular, a boiler drum warming return line isolation and control valve assembly in fluid communication with the boiler drum warming return line 90 and the condenser 96 can control the flow of the at least partially degassed feedwater to the condenser 96. The boiler drum warming return line isolation and control valve assembly can include a first isolation valve 98, a second isolation valve 100, and a flow control valve 102 separating the first isolation valve from the second isolation valve. As shown in FIG. 3, the first isolation valve 98 is in fluid communication with the boiler drum downcomer 20 and the waterwall inlet header 22 via the pair of isolation valves 93 when in an opened state, the second isolation valve 100 is in fluid communication with the condenser 96, and the flow control valve 102 controls a flow of the extracted water in the boiler drum warming return line 90 to the condenser 96 when the first isolation valve 98 and second isolation valves 100 and the pair of isolation valves 93 are in an opened state. It is noted that isolation valves 93 in FIG. 3 are redundant to the first isolation valve 98 in the boiler drum warming return line 90 and serve solely for the purpose of isolating return line 90.

The condenser can cool exhaust steam from a turbine 104. As shown in FIG. 3, the turbine can include a high pressure section 106, an intermediate pressure section 108, and low pressure sections 110. In operation, the high pressure section 106 can receive superheated steam from the superheater (not shown) in the sub-critical steam generator 182 via an inlet stop valve 112. The high pressure section 106 expands and cools the steam to drive a rotary shaft (not shown) that is used to drive an electrical generator (not shown) to generate electricity or provide heat for other purposes. The expanded steam from the high pressure section 106 of the turbine 104 may then be returned to a reheater (not shown) in the sub-critical steam generator 182 downstream from the superheater to reheat the steam. The reheated steam is then directed to the intermediate pressure section 108 of the turbine 104 via an inlet stop valve 114. The intermediate pressure section 108 expands and cools the reheated steam and directs it to the low pressure sections 110 where the steam is successively expanded and cooled to further drive the rotary shaft. It is understood that for purposes of clarity this description of the turbine 104 does not contains all of the operational details. Further, it is understood that the turbine 104 depicted and described with reference to FIG. 3 is only illustrative of one possible turbine configuration and is not meant to be limiting to the various embodiments of the invention.

Turning the discussion, back to the system 180, the condenser 96 can cool exhaust steam from the low pressure sections 110 of the turbine 104, collect the latent heat of the steam, and condense the steam into water. In one embodiment, the condenser 96 is in fluid communication with the deaerator 30, the auxiliary steam source 54, and the boiler drum warming return line 90. In this manner, the condenser 96 can supply the extracted water in the boiler drum warming return line 90 to one or more of the deaerator 30 and the auxiliary steam source 54. In addition, the condenser 96 can supply condensed water from the low pressure sections 110 once the turbine 104 is up and running to one or more of the deaerator 30 and the auxiliary steam source 54.

FIG. 3 shows an embodiment in which a condensate supply line 116 can be in fluid communication with the deaerator 30 and the condenser 96. In this manner, the condensate supply line 116 can supply the recovered at least partially degassed feedwater received by the condenser 96 from the boiler drum warming return line 90 to the deaerator 30, as well as the condensed water from the low pressure sections 110 once the turbine 104 is up and running. In one embodiment, the condensate supply line 116 can comprise a condensate pump 118 to forward the extracted at least partially degassed water and the condensed water from the condenser 96 to the deaerator 30.

In one embodiment, as a skilled person will appreciate, when the turbine 104 is up and running, the supply of water from the condenser 96 to the deaerator 30 can be preheated prior to entering the deaerator by low pressure heaters 120. For example, the low pressure heaters 120 can receive exhaust steam from the low pressure sections 110 of the turbine carried by corresponding low pressure exhaust lines 122. In this manner, the low pressure heaters 120 can use the low pressure exhaust steam carried along the low pressure exhaust lines 122 to heat the low pressure heaters 120 so that heat can be applied to the water in the condensate supply line 116 such that the water is preheated before deaeration in the deaerator 30.

As it can be recognized by the skilled person, exhaust from other sections of the turbine 104 can be used to heat other components of the system 180 once the turbine is up and running. In one embodiment, the at least partially degassed feedwater supplied to the economizer 24 of the sub-critical steam generator 182 can be heated by high pressure heaters 124. In one embodiment, the high pressure heaters 124 can be located about the feedwater supply piping 40 downstream of the feedwater pump 42 and upstream of the economizer 24. The high pressure heaters 124 can receive exhaust steam from the intermediate pressure sections 108 of the turbine 104 carried by corresponding intermediate pressure exhaust lines 126. In this manner, the exhaust steam carried along the intermediate pressure exhaust lines 126 can heat the high pressure heaters 124 so that heat can be applied to the at least partially degassed feedwater in the feedwater supply piping 40 so that the deaerated feedwater is preheated before entering the economizer 24.

As noted above, the condenser 96 can supply the extracted water in the boiler drum warming return line 90 and condensed water from the turbine 104 to the auxiliary steam source 54. In one embodiment, a boiler drum warming return line condensate pump 128 can forward one or more of the extracted water and condensed water in the condenser 96 to the auxiliary steam source 54 along the boiler drum warming return line 90. To this extent, the auxiliary steam source 54 can use the fluid provided by the condenser 96 to generate steam. As noted above, the auxiliary steam source 54 can direct the steam to the deaerator 30 along the deaerator warming supply line 56 via the deaerator warming supply line isolation and control valve assembly (valves 60, 62, 64) and/or to the sparger 50 along the boiler drum warming supply line 58 via the drum warming supply line isolation and control valve assembly (valves 66, 68, 70).

The system 180 can include additional components to facilitate the warmkeeping and at least partially degassed water filling operations in order to facilitate a fast start-up of the sub-critical steam generator 48. For example, as shown in FIG. 3, an economizer vent valve 130 can be configured to displace any oxygen during the at least partially degassed water filling of the economizer 24 or to spill-off excess at least partially degassed water from the economizer 24 via an economizer vent line 132. In one embodiment, the economizer vent valve 130 and the economizer vent line 132 can be in fluid communication with the economizer outlet feedwater line 52 and the sparger 50. In this manner, the economizer vent valve 130 and the economizer vent line 132 can displace any oxygen during the at least partially degassed water filling of the economizer 24 or remove any excess of at least partially degassed feedwater spilling out of the economizer 24. In embodiments, the economizer vent valve 130 can be used to prevent pulling a vacuum in the economizer tubes due to the draining of water.

FIG. 3 shows that the system 180 can further include a boiler drum vent valve 134 to release air from the boiler drum 18 via an air release line 136. In one embodiment, the boiler drum vent valve 134 and the air release line 136 can be in fluid communication with the boiler drum 18. To this extent, the boiler drum vent valve 134 can be configured to release air from the boiler drum 18 via the air release line 136 during the filling of the sub-critical steam generator 182 with the at least partially degassed feedwater. In embodiments, the boiler drum vent valve 134 can be used to prevent pulling a vacuum in the waterwall tubes due to the draining of the water.

As can be recognized by the skilled person, the system 180 can further include a boiler drum blowdown valve 138 to release unwanted sediments from the boiler drum 18 via a blowdown discharge line 140. Unwanted sediments such as for example salt, are necessary to remove from the at least partially degassed feedwater in order to achieve a predetermined level of steam purity that is required for the turbine 104 and for operating the steam generator 182. In one embodiment, the boiler drum blowdown valve 138 and the blowdown discharge line 140 are in fluid communication with the boiler drum 18. To this extent, the boiler drum blowdown valve 138 and the blowdown discharge line 140 can discharge the unwanted sediments in the at least partially degassed feedwater in the boiler drum 18 during the filling of the sub-critical steam generator 182. The removal of the unwanted sediments such as salt from the at least partially degassed feedwater through a desalination process performed about the boiler early in the water filling process along with the heating of the feedwater by the second auxiliary heating device **55*b*, in particular sparger 50**, acts to facilitate the fast start-up that is attained the various embodiments.

FIG. 3 also shows that the system 180 can include an economizer warmup assist line 142 to speed up the warming of at least partially degassed feedwater during the filling of the sub-critical steam generator 182. In one embodiment, the economizer warmup assist line 142 can be in fluid communication with the boiler drum downcomer 20 and the economizer 24 via an economizer warmup assist line control valve 144. In this manner, if it is determined that the feedwater is too cold, then the economizer warmup assist line 142 and the economizer warmup assist line control valve 144 can be utilized to recirculate the at least partially degassed feedwater in the boiler drum downcomer 20 to warm up the feedwater and also the economizer 24.

In order to facilitate the warmkeeping and at least partially degassed water filling in the sub-critical steam generator 182 with the system 180 for a fast start-up without subjecting the critical steam producing components to a brittleness condition and other adverse conditions that can lead to excessive thermal stresses when the steam generator is lit off, the controller 72 has to interact and manage many of the aforementioned components such as for example the valves, the sensors, pumps, etc. Accordingly, the controller 72 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein, which may be accomplished in real-time. For example, the controller 72 may include at least one processor and system memory/data storage structures, which may include random access memory (RAM) and read-only memory (ROM). The at least one processor of the controller 72 may include one or more conventional microprocessors and one or more supplementary co-processors such as math co-processors or the like. The data storage structures may include an appropriate combination of magnetic, optical and/or semiconductor memory, and may include, for example, RAM, ROM, flash drive, an optical disc such as a compact disc and/or a hard disk or drive.

Additionally, a software application that adapts the controller 72 to carry out the operations disclosed herein may be read into a main memory of the at least one processor from a computer-readable medium. The term "computer-readable medium," as used herein, refers to any medium that provides or participates in providing instructions to the at least one processor of the controller 72 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random-access memory (DRAM), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

As noted above, the controller 72 of the system 180 is configured to control the warmkeeping and at least partially degassed water filling to facilitate a fast start-up of the sub-critical steam generator 182 without delay such that the steam producing components are not operated in a brittleness condition or other adverse conditions that can lead to excessive thermal stresses when the steam generator is lit off.

If the water temperature during the filling is below a certain threshold, then the temperature on the outside of the boiler drum 18 has to exceed a minimum required temperature to stay out of the brittle region and in the unlimited fill rate region. As the temperature of the feedwater increases during the filling, the temperature of the boiler drum 18 needs to increase at a gradual rate to stay out of the brittle region and in the unlimited fill rate region.

Figure 4:
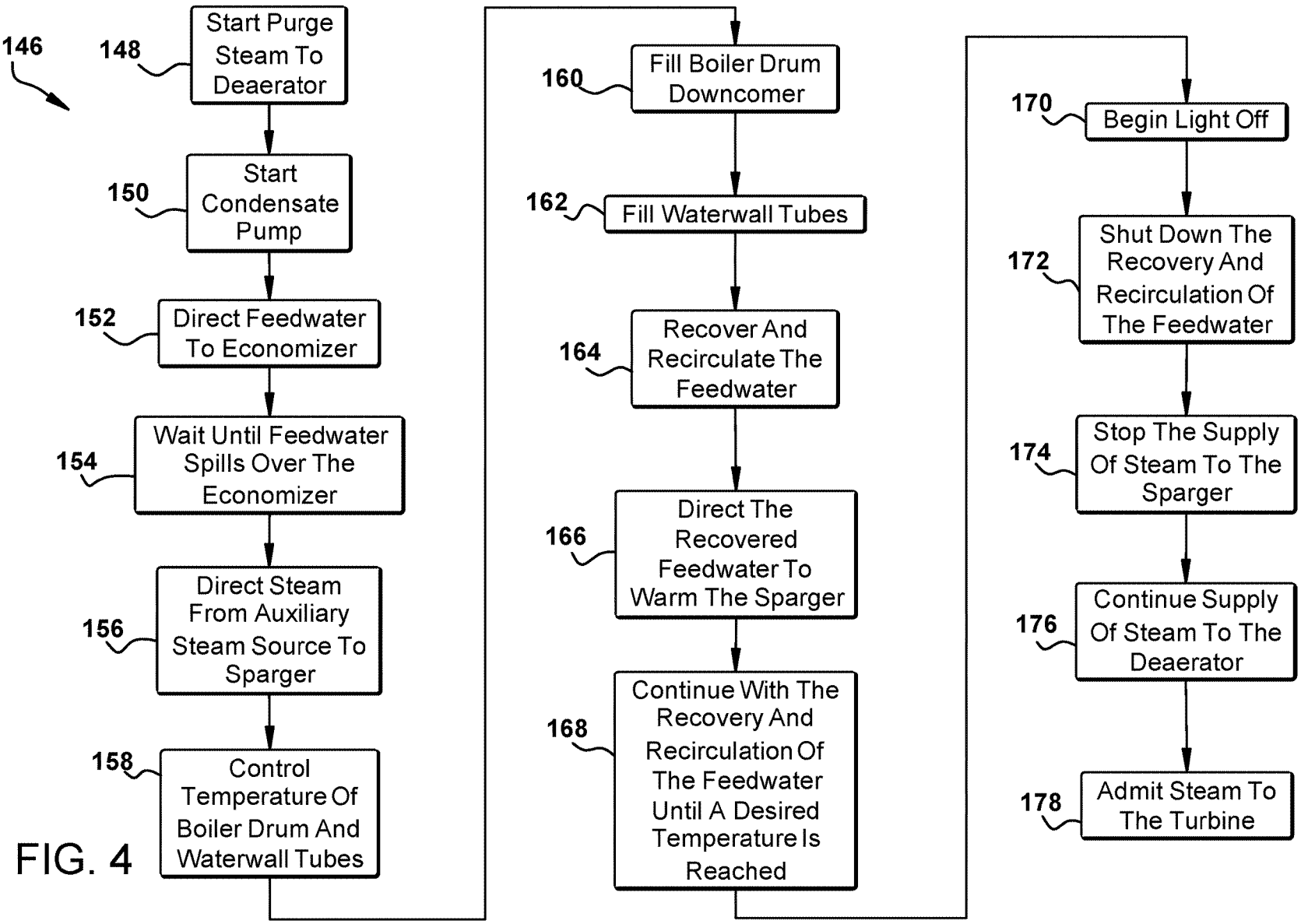
FIG. 4 shows a flow chart describing the readying operations associated with the system depicted in FIG. 3 according to another embodiment of the invention.

With a known temperature relationship of water filling temperature versus metal surface temperature, the controller 72 can be configured to control the at least partially degassed water filling and warmkeeping of the sub-critical steam generator 48 to a fast start-up that keeps the stress critical steam producing components out of brittleness conditions or other adverse conditions that can lead to excessive thermal stresses when the steam generator is lit off. FIG. 4 illustrates a start-up sequence for the sub-critical steam generator 182 using the system 180. In particular, FIG. 4 shows a flow chart 146 describing the readying operations associated with the system 180 depicted in FIG. 3 and the temperature relationships as the basis to control the operations in a manner that avoids brittleness and excessive thermal stress conditions.

In general, the sub-critical steam generator 182 at this point is in a cold stand-by mode in an unfired state such that the steam generator is almost at ambient temperature. For example, if the temperature is near freezing, then the temperature of the fill water in the sub-critical steam generator 182 in the unfired state can be within the brittle region. The at least partially degassed water filling and warmkeeping operations that are embodied by the readying process of FIG. 4 keeps the sub-critical steam generator 182 out of the brittle region and within the allowable thermal stress regions as the steam generator transitions from the unfired stand-by mode to the firing mode.

The operations of the start-up depicted in the flow chart 146 of FIG. 4 begin at 148 where a purge steam to the deaerator is started. In particular, the controller 72 can adjust the valves (60, 62, 64) of the deaerator warming supply line isolation and control valve assembly steam to have steam from the auxiliary steam source 54 directed to the deaerator 30 via the deaerator warming supply line 56.

In order to complement the heating of the deaerator 30 with the steam provided by the auxiliary steam source 54, the condensate pump 118 is started at 150. In this manner, the condensate pump 118 will supply condensed water from the condenser 96 to the deaerator 30 via the condensate supply line 116. The water level of the deaerator 30 can be controlled by leaking off the supply of condensed water at the condensate pump 118 (leak-off not shown).

The at least partially degassed feedwater produced in the deaerator 30 can be directed to the economizer 24 of the sub-critical steam generator 182 at 152. In particular, the feedwater pump 42 is started and the at least partially degassed feedwater in the deaerator 30 can be supplied to the economizer 24 via the feedwater supply piping 40. To this extent, at the economizer 24, the at least partially degassed feedwater, which can be around 21° C. (70° F.), will begin to fill up and warm the economizer 24. The water level of the economizer 24 can be controlled by leaking off the supply of the at least partially degassed feedwater at the feedwater pump 42 (leak-off not shown).

The filling of the at least partially degassed feedwater in the economizer 24 continues until the feedwater spills over top of the economizer 24 as noted in 154. In general, the economizer 24 is not considered a stress critical component that is subject to brittleness conditions and excessive thermal stress conditions, and thus the at least partially degassed feedwater can be filled in the economizer at an unlimited fill rate. When the at least partially degassed feedwater spills over the top of the economizer 24, the excess feedwater will flow towards economizer vent line 132 via the economizer vent valve 130.

At this point, the temperature of the metals of the steam producing components of the sub-critical steam generator 182 are relatively cold. In order to have the sub-critical steam generator 182 operate with an unlimited fill rate and outside the brittleness condition, a suitable temperature differential between the temperature of the outside wall of the boiler drum 18 and the temperature of the fill water needs to be maintained. As a result, the flow chart operations direct the warming to the steam producing components of the sub-critical steam generator 182 such as the boiler drum 18, the boiler drum downcomer 20, the waterwall inlet header 22 and the waterwall tubes 16. In particular, the steam from the auxiliary steam source 54 is directed to the sparger 50 at 156. To this extent, the controller 72 can adjust the valves (66, 68, 70) of the drum warming supply line isolation and control valve assembly to have steam from the auxiliary steam source 54 directed to the sparger 50 via the boiler drum warming supply line 58.

In order to ensure that the sub-critical steam generator 182 can operate with an unlimited fill rate, the controller 72 can control the temperature of the stress critical steam producing components such as the boiler drum 18 and the waterwall tubes 16 according to predetermined specified limits at 158. For example, the controller can obtain the temperature at the discharge from the sparger 50 via the sparger temperature sensor 76, the temperature of the outside wall of the boiler drum 18 via the boiler drum temperature sensor 74, and the temperature of the waterwall tubes 16 via the waterwall temperature sensor 78. By knowing the acceptable temperature differentials between fill water temperature and boiler drum outer surface temperature, the controller 72 can then control the warming of the at least partially degassed feedwater by the sparger 50 or any other similar heating element as the feedwater enters the boiler drum 18 in order to avoid subjecting the stress critical components such as the boiler drum and the waterwall tubes 16 to too much stress. In particular, the controller 72 can dose the amount of steam directed from the auxiliary steam source 54 to obtain the desired temperature differential.

The flow chart 146 can continue at 160 where the warmed at least partially degassed feedwater passes from the boiler drum 18 to fill the boiler drum downcomer 20. As noted previously, although FIG. 3 shows the boiler drum downcomer 20 as a single downcomer it is understood that the downcomer can include more than one. In any event, during the filling of the boiler drum downcomer 20, the controller 72 can monitor the temperature of the outside wall of the boiler drum 18 and if necessary, the flow control valve 70 of the drum warming supply line isolation and control valve assembly can be throttled to attain a desired temperature. During the filling of the boiler drum downcomer 20 the waterwall tubes 16 of the sub-critical steam generator 182 are filled with the warmed at least partially degassed feedwater via the waterwall inlet header 22 at 162.

The at least partially degassed feedwater will eventually fill out the waterwall tubes 16 and the downcomer 20. Then the water level in the boiler drum 18 will rise and will eventually reach a nominal level as water flows back into the boiler drum via the top-end piping 26 and the boiler drum warming supply line 58 and the economizer outlet feedwater line 52. The controller 72 can then obtain temperature measurements of the outside wall of the boiler drum 18 and the waterwall tubes 16 to gain an understanding of how far along in the filling process is it towards readying the sub-critical steam generator 48 for commencing firing for light off. Once the filling of the waterwall tubes 16 is completed and nominal water level has been reached in the boiler drum 18, the controller 72 can monitor the pressure of the boiler drum 18 with the boiler drum pressure sensor 88 and limit the release of air from the boiler drum 18 to the air release line 136 via the boiler drum vent valve 134. In one embodiment, the controller 72 can monitor the boiler drum pressure to control it in a manner such that it does not exceed approximately 80% of the outlet pressure of the auxiliary steam heat source 54. In addition, during this time sediments from the warmed at least partially degassed feedwater such as salt can be removed from the boiler drum 18 on the blowdown discharge line 140 via the boiler drum blowdown valve 138 to attain a predetermined steam purity in the steam leaving the boiler drum 18.

With feedwater in nominal levels in the economizer 24, the boiler drum 18 and the waterwall tubes 16, excess water can be recovered and recirculated at 164 assuming that the water is considered in good condition for recovery and recirculation. Otherwise, the excess water will be discharged out the discharge line 94 or through the blowdown discharge line 140. In any event, the recovered and recirculated water will be directed to the condenser 96 and the auxiliary steam source 54 via the boiler drum warming return line 90 and the valves (98, 100, 102) of the boiler drum warming return line isolation and control valve assembly. The auxiliary steam source 54 can use the recovered water to produce steam that is directed to the sparger 50 via the boiler drum warming supply line 58 at 166. In this manner, the sparger 50 will warm the at least partially degassed feedwater entering the boiler drum 18, and thus heat further the steam producing components such as the boiler drum 18, the boiler drum downcomer 20, the waterwall inlet header 22 and the waterwall tubes 16. In particular, the controller 72 can obtain the aforementioned temperature and pressure measurement to ensure that the mixing temperature is in agreement with the specified boiler drum temperature limits.

While raising the mixing temperature and driving it to agreement with the specified boiler drum temperature limits, the controller 72 will also control the mixing temperature to stay below a saturation temperature calculated per the measured boiler drum pressure obtained from the boiler drum pressure sensor 88. If the water level stabilizes at a nominal level and it is determined that the discharge temperature at the outlet of the sparger 50 has reached the saturation temperature calculated from the boiler drum pressure, then the controller 72 can close the boiler drum vent valve 134.

The recovery and recirculation of the feedwater back into the sub-critical steam generator 182 continues at 168 until a desired temperature is attained at the boiler drum 18 and the waterwall tubes 16. Once the boiler drum 18 and the waterwall tubes 16 have reached the desired temperature, the sparger 50 can be taken out of control and light off can begin at 170. In essence, a start-up condition has been reached, and as a result, firing of the sub-critical steam generator 182 can be ignited.

With the light off, a boiler purge will begin. During the boiler purge, the controller 72 will reduce and ultimately shut down the recovery and recirculation of the feedwater at 172. In particular, the controller 72 will adjust the valves (98, 100, 102) so that there is no flow along the boiler drum warming return line 90. In addition, during this time, the controller 72 will reduce and ultimately stop the supply of steam from the auxiliary steam source 54 to the sparger at 174 in agreement with the previously attained or desired boiler drum outside wall temperature. In particular, the controller 72 will adjust the valves (66, 68, 70) so that there is no flow of steam along the boiler drum warming supply line 58. The auxiliary steam source 54 will continue to supply steam to the deaerator at 176 along the deaerator warming supply line 56. In this manner, the deaerator 30 can continue to degas and warm the feedwater to the economizer 24.

During the boiler firing, the controller 72 will monitor the furnace gas exit temperature obtained by the furnace exit gas temperature sensor 80 as at this point there is no flow out of the superheater and reheater in the sub-critical steam generator 182. If the furnace exit gas is below a predetermined temperature, the controller 72 can allow the temperature of the waterwall tubes 16 and the boiler drum pressure to increase a significant amount to allow the exhaust of the steam to be brought to the superheater so that the piping to the turbine 104, and in particular, the high pressure section 106 and the intermediate pressure section 108 can be warmed up. To this extent, steam flow can be directed to the high pressure section 106 and brought back to the reheater for subsequent flow to the intermediate pressure section 108 of the turbine 104. The start-up process is now complete and all that is necessary is to wait for the metals of all of the various components to heat up before admitting steam from the sub-critical steam generator 182 to the turbine 104 at 178.

While for purposes of simplicity of explanation, the operations shown in FIG. 4 are described as a series of acts. It is to be understood and appreciated that the subject innovation associated with FIG. 4 is not limited by the order of acts, as some acts may, in accordance therewith, occur in a different order and/or concurrently with other acts from that shown and described herein. For example, those skilled in the art will understand and appreciate that a methodology or operations depicted in FIG. 4 could alternatively be represented as a series of interrelated states or events, such as in a state diagram. Moreover, not all illustrated acts may be required to implement a methodology in accordance with the innovation. Furthermore, interaction diagram(s) may represent methodologies, or methods, in accordance with the subject disclosure when disparate entities enact disparate portions of the methodologies. Further yet, two or more of the disclosed example methods can be implemented in combination with each other, to accomplish one or more features or advantages described herein.

While the flow chart 146 has been described with respect to the aforementioned components of system 180 depicted in FIG. 3, it is understood that other configurations can be utilized that provide at least partially degassed filling and warmkeeping to attain a fast start-up of a sub-critical steam generator all while ensuring that steam producing components are not subjected to a brittleness condition and other adverse conditions that can lead to excessive thermal stresses when the steam generator is lit off.

It is understood that the configurations depicted and described with respect to the sub-critical steam generator 182 shown in FIG. 3 are not exhaustive of all possible systems for readying a sub-critical steam generator and are not meant to be limiting. For example, FIG. 5 shows a schematic of system 184 for readying a sub-critical steam generator 186 for a fast start-up according to another embodiment of the invention. In this embodiment, the system 184 does not contain a recovery and recirculation loop as utilized in the system 180 of FIG. 3. To this extent, the system 184 would operate in a similar manner to the system 180 except for the recovery and recirculation of the feedwater from the sub-critical steam generator.

As noted above, a super-critical steam generator is an example of another type of steam generator that the aforementioned aspects of readying a steam generator with degassed and (pre-)heated water filling for a fast start-up have applicability. FIG. 6 shows a schematic of a system 188 for readying a super-critical steam generator 190 for fast start-up that includes a high pressure start-up system 191 and a low pressure start-up system 193. Instead of a boiler drum, the super-critical steam generator 190 uses one or more separators 192 (hereafter referred to as "the separator 192") to separate the saturated water created in the waterwall tubes 16 into water and steam. A separator storage tank (SST) 194 stores the water separated by the separator 192. An isolation and control valve assembly in fluid communication with the economizer 24 via a minimum economizer flow return line 196 can supply the water from the separator storage tank 194 to the economizer 24. This isolation and control valve assembly can include a first isolation valve 198, a second isolation valve 200, and a minimum economizer flow control valve 202 disposed between the isolation valves 198 and 200.

In one embodiment, a boiler water circulation pump (BWCP) 204 can supply the water from separator storage tank 194 to the economizer 24 via the isolation and control valve assembly formed from valves 198, 200, 202 and the minimum economizer flow return line 196. This water and the at least partially degassed feedwater provided by the deaerator 30 are warmed by the economizer 24. The warmed water and at least partially degassed feedwater pass from the economizer 24 into the waterwall tubes 16 via the economizer outlet feedwater line 52, one or more downcomers 206 (collectively referred to as "the downcomer 206") and the waterwall inlet header 22.

The system 188 can also include a warmkeeping aspect that involves extracting degassed feedwater that is to be supplied to the waterwall tubes 16 and forwarding the extracted feedwater for recovery and recirculation back to the deaerator 30 and subsequently to the economizer 24 of the super-critical steam generator 190, as well as to the auxiliary steam source 54 for reheating the deaerator 30. As shown in FIG. 6, a boiler flash tank (BFT) 208 can receive water from the separator storage tank (SST) 194 via an isolation and control valve assembly that includes an isolation valve 210 and a high water level control valve 212. In one embodiment, excess water from the boiler flash tank 208 can be provided to a flash tank drain tank (FTDT) 214 via a condensate return line 216. The boiler flash tank (BFT) can be used as a vessel in which steam or water of any pressure can expand to liquid at atmospheric pressure and form a condensate. The boiler flash tank (BFT) can also be used to store excess of water from SST.

As shown in FIG. 6, a boiler condensate pump 218 can supply the extracted feedwater in the flash tank drain tank 214 to the condenser 96 along the condensate return line 216. In one embodiment, an isolation and control valve assembly formed from a first isolation valve 220, a second isolation valve 222, and a control valve 224 disposed between the isolation valves can be used to facilitate the extraction of the feedwater from the flash tank drain tank 214 to the condenser 96 along the condensate return line 216. The condenser 96 can supply this extracted feedwater back to the deaerator 30 via the condensate pump 118 and the low pressure heaters 120 or via the auxiliary steam source 54 and the deaerator warming supply line 56.

If it is not desirable to use the degassed feedwater for recovery and recirculation, then the excess water in the boiler flash tank 208 can be discharged from the super-critical steam generator 190. For example, in one embodiment, the excess water can be directed by the controller 72 to discharge the water via a boiler flash tank drain line 226 and one or more boiler flash tank discharge isolation valve(s) 228.

As an option, FIG. 6 shows that the system 188 can divert some or all of the water from the separator 192 that is to be supplied to the economizer 24 via the minimum economizer flow return line 196 to go direct to the waterwall inlet header 22 for supply to the waterwall tubes 16. For example, a minimum waterwall flow return line 230 can provide the diverted water from the minimum economizer flow return line 196 to the waterwall inlet header 22 via an isolation and control valve assembly that includes a first isolation valve 232, a second isolation valve 234, and a bypass flow control valve 236 in fluid communication with the isolation valves. By introducing the bypass line 230, the warming up of the separator 192 can be accelerated through passing heated liquid directly to the waterwall without losing the heat and operating the waterwall just below the critical point, thereby avoiding the "void" effect, i.e., avoiding of water in selected tubes to steam out.

The system 188 can include additional components to facilitate the warmkeeping and at least partially degassed water filling operations in order to facilitate a fast start-up of the super-critical steam generator 190. For example, as shown in FIG. 6, a waterwall vent valve 238 and a waterwall vent line 240 can release air from the outlet header of the waterwall tubes (i.e., the furnace top-end piping 26). The waterwall vent valve 238 and the waterwall vent line 240 allows the system 188 to release air from the waterwall tubes 16 during the filling of the super-critical steam generator 190 with the at least partially degassed feedwater.

Like the sub-critical steam generators described above, the system 188 associated with the super-critical steam generator 190 can include a plurality of auxiliary heating devices 55 (e.g., 55*a*-55*d*) for warming the stress critical steam producing components and/or (pre-)heating the at least partially degassed feedwater flowing to or from the components during the filling of the water fill circuits. As shown in FIG. 6, e.g., a first auxiliary heating device 55*a* can be disposed on one or more water-steam separator 192. A second auxiliary heating device 55*b* can be configured to (pre-)heat at least partially degassed feedwater water discharged by waterwall before an inlet of the separator 192. In one embodiment, the second auxiliary heating device 55*b* can be disposed about the waterwall outlet header (e.g., furnace top-end piping 26). A third auxiliary heating device 55*c* can be configured to provide heat to the deaerator 30 to keep the deaerator at the required condition at mass flows as provided by the feedwater pump 42. A fourth auxiliary heating device 55*d* can be disposed about the economizer 24 to protect the economizer from freezing. The first, the second, the third and the fourth auxiliary heating devices 55 can include any of the aforementioned heating devices.

With the system 188 for readying the super-critical steam generator 190, the following methods can be applied. For example, during shutdown of the super-critical steam generator 190, the separator 192 is kept filled with water and blanketed with nitrogen and/or the deaerator 30 is bottled up together with the third auxiliary heating device 55*c*, and the economizer 24 is bottled up together with the fourth auxiliary heating device 55*d*, such that the gas diffusion is limited to the water-air interface while the bottled water remains degassed. Furthermore, the separator 192 and the waterwall outlet header are kept warm above its brittleness condition per the first auxiliary heating device 55*a* and the second auxiliary heating device 55*b*.

On start-up of the super-critical steam generator 190, the deaerator 30 can be heated up to operation condition to at least partially remove the dissolved gas before the feedwater pump 42 is started and begins to subject the feedwater to the economizer 24. The second auxiliary heating device 55*b* can be used to (pre-)heat the discharged, degassed feedwater exhausted from the waterwall before filling it into the separator 192. The (pre-)heated water entering the separator 192 will fill the separator. This (pre-)heated water can be used to flush decontaminated water in the boiler recirculation system. When the separator 192 is filled with degassed feedwater, the mass flow regulated boiler recirculation pump 218 can be started to heat up the waterwall, well before the furnace 12 is purged and the auxiliary fuel combustor is ignited.

In one embodiment, the filling of the super-critical steam generator 190 with feedwater, the (pre-)heating of the at least partially degassed feedwater with the second auxiliary heating device 55*b*, the warming of the separator with the first auxiliary heating device 55*a*, and the auxiliary fuel combustor can be controlled by a controller 72 based on temperature measurements obtained about the steam generator and the auxiliary heating devices 55. To this extent, the controller 72 can control the inlet temperature of the separator feedwater and the outlet temperature of the waterwall at a safe temperature rise rate and temperature differential of components like the separator 192, the waterwall inlet header 22, or the waterwall tubes 16. As thick-walled components are warm kept at ductile condition, the safe temperature rise rates of the thin-walled components like the waterwall are allowed to bring in short time all components to ductile conditions. Having all components in ductile condition, the thick-walled components will limit safe temperature rise rate.

The above methods of the super-critical steam generator 190 can be implemented to operate during the start-up operation of the generator. In general, the start-up operation of the super-critical steam generator 190 under cold-start conditions can be described as follows. Before light off of the super-critical steam generator 190, the following verification steps are completed:

- The deaerator 30 is operational and deaerated feedwater at a predetermined temperature is available therein.
- The boiler water recirculating pump (BWCP) 204 has been checked out, the isolation valves 198, 200 are open, and all pump instrumentation is available for service.
- The super-critical steam generator start-up system valves are ready for operation (202, 212), with isolation valves 198, 200, and 210 open. The SST 194 level control using HWL valve(s) 212 has been checked and is available for service.
- The startup system drain transfer system comprising the boiler flash tank (BFT) 208, the flash tank drain tank (FTDT) 214, and drain transfer pump(s) 218 is ready for operation.
- Auxiliary steam 54 is available from another operating boiler or common system for supplying the deaerator 30, and feedwater tank.
- The temperature probe 80 or other device for measuring furnace gas outlet temperature is in working order and available for service.

For the warm water filling of the super-critical steam generator, the entire economizer 24, waterwall tubes 16, and separator 192 must be filled with warm deaerated water (e.g., 104° C. (219° F.)) and be free of air. In order to ensure the water system is free of air, the following procedure can be carried out:

- The economizer vent valve 130 and waterwall vent valve 238 are open.
- The boiler feedwater pump (BFP) 42 is started at minimum setting and flow according to predetermined feed pump operating procedures.

The drain transfer pump(s) between flash tank drain tank (FTDT) 214 and condenser 96 are switched to automatic control in start-up position.

If the water system of the boiler is empty (economizer, furnace walls, separators), then the system is to be filled with approximately 10% BMCR feedwater flow (BMCR=Boiler Maximum Capability Rating). Feedwater flow is preferably controlled using automatic feedwater control with a set point of 10% BMCR.

Close the economizer vent valve 130 and waterwall vent valve 238 as soon as a clear stream of water is discharged or level is building up in separator storage tank (SST) 194.

When the level in the SST 194 reaches the high water level setpoint, the HWL valve 212 will begin to open. Increase boiler feedwater flow to the equivalent of 30% BMCR feedwater flow and ensure that the HWL valve 212 reaches >30% open for more than two minutes. The water system is considered full when:

a. The SST water level remains stable for 2 minutes with feedwater flow at 30% of BMCR feedwater flow; and b. The HWL valve 212 has been actively limiting SST 194 level during the above 2 minutes.

After filling the water system, the feedwater flow to the boiler can be reduced to 0% (BFP 42 can remain on minimum flow recirculation, recirculation line not shown). During boiler filling, the water level in the deaerator 30 and water temperature of 104° C. (219° F.) must be maintained.

In one embodiment for the super-critical steam generator 190, a pre-boiler water recirculation for clean-up phase can occur. The pre-boiler water recirculation for clean-up phase involves carrying out the following procedure:

When feedwater quality at the outlet of the deaerator 30 and high pressure heaters 124 is not within the required limits (based on sample analysis), a pre-boiler clean-up recirculation is necessary.

During this time, constant feedwater flow of 10% of BMCR feedwater flow or more is maintained.

Pressurize the deaerator 30 with auxiliary steam from the auxiliary steam source 54, establish condenser vacuum, and place a condensate polisher (not shown in figures) in service.

Water is circulated through the entire pre-boiler system from condenser 96 hotwell through the last high pressure heaters 124, including the condensate polisher (not shown here), and returned to the condenser via a dedicated recirculation line (not shown here).

The recirculation is continued until the water quality is within the specified limits, based on samples taken at the deaerator 30 and high pressure heaters 124.

In one embodiment for the super-critical steam generator 190, a water recirculation via boiler for clean-up phase can occur. The water recirculation via boiler for clean-up phase involves carrying out the following procedure:

When the feedwater quality at the outlet of SST 194 is not within the required limits (based on sample analysis), a feedwater clean-up recirculation via the boiler is necessary.

After the control limits have been met at the high pressure heater 124 outlet, close the pre-boiler recirculation control valve and establish flow through the economizer 24, waterwall (evaporator), separator 192, and SST 194, and discharge from the boiler through HWL 212 to the boiler flash tank 208, the flash tank drain tank 214 and condensate drain pump 218 and the isolation and control valve assembly (valves 220, 222, 224) back to the condenser 96.

Water flow circulation is continued through the entire condensate system, including the condensate polisher (not shown here), feedwater system, and boiler water system to remove impurities.

During this time, constant feedwater flow of 10% of BMCR feedwater flow or more is maintained.

The recirculation is continued until the water quality is within the specified limits, based on samples taken at the SST 194 discharge.

In one embodiment for the super-critical steam generator 190, a start of the boiler recirculation pump phase can occur. The start of the boiler recirculation pump phase involves carrying out the following procedure:

Assume that the following preparatory work has been completed:

a. Feedwater quality within specified limits.

b. Feedwater flow setpoint at 10% of BMCR feedwater flow.

c. SST 194 water level stable with HWL valve 212 at stable opening.

d. Isolation valve 198 and discharge valve 200, are open.

Set the minimum economizer flow control valve (MEFCV) 202 at minimum (pump start) position, select MEFCV to auto, and start BWCP 204 per pump operating instructions.

As soon as the BWCP 204 is running, SST 194 level will decrease as the upper circuits are filled. Maintain 10% of BMCR boiler feedwater flow until SST 194 level shows sustained increase. Monitor the MEFCV 202 auto-action to establish economizer inlet flow at the nominal flow setpoint (approx. 35% of BMCR flow). As SST 194 level attains normal operational setpoint, reduce feedwater flow to the boiler to zero and select to auto.

With the BWCP 204 in operation, flow through the economizer 24 and waterwall tubes 16 increases substantially. At this point, the water quality at the separator 192 can be re-checked. If necessary, continue to circulate water via the clean-up loop, including the polishing plant, until control limits are met at the separator 192 outlet prior to initial firing.

The super-critical steam generator 190 is at this point generally ready for lighting off. However, to ensure a maximum safety margin during start-ups, at least 30% of the full load airflow should be maintained to produce the following initial firing precaution conditions:

An air-rich furnace atmosphere. This prevents the accumulation of an explosive mixture due to poor or delayed ignition after fuel is introduced to the furnace.

High excess air through the air heaters. This minimizes the dilution of combustion air by inert gases carried over by the air heater rotors.

The super-critical steam generator 190 will normally be started-up de-coupled from the turbine using the HP and LP bypass systems (not shown), which provide a steam flow path through the superheater, to the reheater, and to the condenser 96. This provides additional flexibility for adjusting steam temperatures to match turbine requirements at start-up. The primary methods for controlling steam temperature will be firing rate and airflow adjustment.

With the completion of the aforementioned processes, the super-critical steam generator 190 is ready for light off. The light off of the super-critical steam generator 190 can include the following operations:

Start the air heaters (not shown here).

Start the first draft group (not shown here).

Start the second draft group (not shown here).

Adjust the fans to permit a purge airflow of a predetermined amount and a furnace draft of a predetermined amount.

Check that all other purge permissives are satisfied.

Place the temperature probe 80 (e.g., a thermoprobe) into service to measure furnace exit gas temperature.

Furnace Pressure control is in automatic.

Unit air flow is in automatic maintaining minimum unit air flow of 30%.

Start-up system (BWCP 204 and MEFCV valve 202) is on automatic maintaining the waterwall flow at minimum flow setpoint.

Initiate a furnace purge.

Upon completion of the purge cycle, check that all firing prerequisites are satisfied, including the following control settings:

a. Boiler feedwater control setpoint is maintained at 5% to 10% of BMCR flow with the HWL valve 212 active and limiting SST 194 level to continuously purge the solids that may concentrate in the separator storage tank 194 during startup and thereby continuously cleans the fluid in the furnace walls. If water quality is confirmed, this setpoint can be reduced to zero to reduce water losses.

b. SST 194 level control is in automatic (feedwater flow is controlling SST 194 level at normal setpoint), and the HWL valve(s) 212 are all in automatic.

When lighting off the first elevation of gas or any other start-up fuel, secondary air dampers in the windbox are selected as either auxiliary air or fuel air control automatically based on the fuel in service and are positioned automatically. Once ignition of the main fuel is established, the fuel-air dampers are opened in proportion to the fuel elevation firing rate.

Place the high pressure bypass valve in auto operation.

Place the low pressure bypass valve in operation.

Start one seal air fan.

Open the individual seal air valves on each pulverizer.

When the seal air to pulverizer underbowl pressure differential is adequate, open the cold air gates to provide a purge air flow path through the pulverizers.

Start at least one fan for pulverizer air flow. When the fan(s) are requested to start, the pulverizer cold air dampers will be positioned to 5% open.

After fan(s) are started, open the fan outlet dampers. Bring the primary hot air duct pressure up to set point by manually adjusting the fan flow control device. Then, transfer to automatic control.

While the operations of the above processes for the super-critical steam generator 190 are described as a series of acts. It is to be understood and appreciated that the subject innovation associated with these operations is not limited by the order of acts, as some acts may, in accordance therewith, occur in a different order and/or concurrently with other acts from that described herein. For example, those skilled in the art will understand and appreciate that a methodology or operations for the super-critical steam generator 190 could alternatively be represented as a series of interrelated states or events. Moreover, not all the acts may be required to implement the methodologies in accordance with the innovation of the various embodiments. Further yet, two or more of the disclosed example methods can be implemented in combination with each other, to accomplish one or more features or advantages described herein.

From the description of the illustrated embodiments presented herein, it should be evident that the subject disclosure sets forth an effective solution for attaining a fast start-up of a sub-critical steam generator and a super-critical steam generator that provides at least partially degassed water filling along with warmkeeping while ensuring that steam producing components are not subjected to a brittleness condition and other adverse conditions that can lead to excessive thermal stresses when the steam generator is lit off after being in an unfired stand-by mode of operation. The embodiments describe many new and unique features. These features include, but are not limited to, keeping the steam generator above a brittleness condition at a maximum waterwall filling temperature, readiness of the deaerator, start of steam generator filling, heating of fill water upstream of the most stress critical components of the steam generator, continuous warming flow per a closed loop coupling, early firing and steam blow out of entrapped air in the high pressure superheater section of the steam generator, early reduction of sediment (e.g., salt) content in the feedwater per a blow down, and a substitution of auxiliary steam through a high pressure turbine section bypass system.

These features afford the various embodiments of the present invention with many technical and commercial advantages. For example, there will be a stress limited start-up of the sub-critical steam generator and the super-critical steam generator. This includes a minimal waiting time to overcome brittleness conditions that can be problematic to stress critical components of the steam producing components of the steam generator (e.g., a sub-critical steam generator or a super-critical steam generator) as the steam generator transitions from a stand-by, unfired mode of operation to a firing mode of operation. A low possible auxiliary fuel consumption and an increased lifetime use are associated with the stress limited start-up. Other advantages of the various embodiments can include an earlier steam turbine release and hence less start-up fuel consumption. For turbine system without a bypass there will be reduced precipitation/maintenance.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. For example, parts, components, steps and aspects from different embodiments may be combined or suitable for use in other embodiments even though not described in the disclosure or depicted in the figures. Therefore, since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below. For example, references to "one embodiment" of the present invention are not intended to be interpreted as excluding the existence of additional embodiments that also incorporate the recited features.

In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. The terms "substantially," "generally," and "about" indicate conditions within reasonably achievable manufacturing and assembly tolerances, relative to ideal desired conditions suitable for achieving the functional purpose of a component or assembly. Further, the limitations of the following claims are not written in means-plus-function format and are not intended to be interpreted as such, unless and until such claim limitations expressly use the phrase "means for" followed by a statement of function void of further structure.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings, such terms are intended to be inclusive in a manner similar to the term "comprising" as "comprising" is interpreted when employed as a transitional word in a claim. That is, unless explicitly stated to the contrary, embodiments "comprising," "including," or "having" an element or a plurality of elements having a particular property may include additional such elements not having that property. Moreover, articles "a" and "an" as used in the subject specification and annexed drawings should generally be construed to mean "one or more" unless specified otherwise or clear from context to be directed to a singular form.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system for readying a steam generator, wherein the steam generator comprises:

at least one water-steam separator, an economizer, an auxiliary fuel combustor for warming up the steam generator using auxiliary fuel, a waterwall inlet header, and a furnace, wherein the furnace includes waterwall tubes, and wherein the waterwall tubes are connected to said at least one water-steam separator with furnace top-end piping, and wherein the system comprises:

a first auxiliary heating device disposed on said at least one water-steam separator for heating said at least one water-steam separator, and a second auxiliary heating device disposed at least on a part of the furnace top-end piping for heating the furnace top-end piping, and wherein the system further comprises:

a controller for controlling the steam generator and the auxiliary heating devices, and a measurement system including pressure and/or temperature sensors for providing pressure and/or temperature measurements, wherein the measurement system is configured to provide pressure and/or temperature measurements of the steam generator and pressure and/or temperature measurements of the system for readying the steam generator to the controller.

2. The system according to claim 1, wherein the steam generator further comprises:

a heating system for providing at least partially degassed water to the economizer, and a condenser connected to the heating system with a condensate supply line for providing condensate to the heating system, wherein the heating system is connected to the economizer with feedwater supply piping.

3. The system according to claim 2, wherein the heating system is a deaerator for providing at least partially degassed water, wherein the system further includes:

a third auxiliary heating device disposed on the deaerator for heating the deaerator, and/or a fourth auxiliary heating device disposed on the economizer for heating the economizer.

4. The system according to claim 3, wherein the steam generator further includes:

at least one auxiliary heating source connected to the deaerator with a deaerator warming supply line, and wherein said at least one auxiliary heating source comprises a steam source.

5. The system according to claim 4, wherein the steam generator further comprises:

a steam turbine comprising at least one low pressure section, wherein the condenser is connected with said at least one auxiliary heat source, wherein the condenser is connected with said at least one low pressure section for condensing the steam exhaust from said at least one low pressure section to obtain said condensate, and wherein said at least one low pressure section is connected with at least one low pressure heater disposed on the condensate supply line for heating water in the condensate supply line.

6. The system according to claim 5, wherein the steam turbine further comprises:

at least one intermediate pressure section, wherein said at least one intermediate pressure section is connected with at least one high pressure heater disposed on the feedwater supply piping for heating water in the feedwater supply piping.

7. The system according to claim 4, wherein the steam generator is a sub-critical steam generator and said at least one water-steam separator is a boiler drum, and wherein the steam generator further comprises:

an economizer outlet feedwater line connecting the economizer and the boiler drum, and at least one downcomer connecting the boiler drum with the waterwall inlet header, and wherein the system comprises:

a fifth auxiliary heating device disposed at least on a part of the economizer outlet feedwater line for heating the economizer outlet feedwater line.

8. The system according to claim 7, wherein the fifth auxiliary heating device is a sparger, and wherein the sparger is connected with said at least one auxiliary heat source by a boiler drum warming supply line.

9. The system according to claim 7, wherein the waterwall inlet header is connected with said at least one water-steam separator with said at least one downcomer, and wherein the system comprises:

a boiler drum warming return line connecting said at least one downcomer with the condenser and/or connecting the waterwall inlet header with the condenser, and/or an economizer warmup assist line connecting said at least one downcomer with the economizer.

10. The system according to claim 2, wherein the steam generator is a super-critical steam generator, and wherein said at least one water-steam separator includes:

a separator storage tank connected at the outlet of said at least one water-steam separator, and wherein the system further comprises:

a minimum economizer flow return line connecting the separator storage tank with the economizer, and/or a condensate return line connecting the separator storage tank with the condenser.

11. The system according to claim 10, wherein the condensate return line includes:

a boiler flash tank for receiving water from the separator storage tank prior to transporting said water to the condenser, and/or wherein the minimum economizer flow return line includes:

a minimum waterwall flow return line connecting the minimum economizer flow return line with the waterwall inlet header.

12. A method of operating of a steam generator, wherein the steam generator includes:

at least one water-steam separator, an economizer, an auxiliary fuel combustor for warming up the steam generator using auxiliary fuel, a waterwall inlet header, a heating system comprising a deaerator connected to the economizer for providing at least partially degassed water to the economizer, and a furnace, wherein the furnace includes waterwall tubes, and wherein the waterwall tubes are connected to said at least one water-steam separator with furnace top-end piping, and wherein the method includes:

installing of a system for readying the steam generator, wherein the system comprises:

a first auxiliary heating device disposed on said at least one water-steam separator for heating said at least one water-steam separator, a second auxiliary heating device disposed at least on a part of the furnace top-end piping for heating the furnace top-end piping, a third auxiliary heating device disposed on the deaerator for heating the deaerator, a fourth auxiliary heating device disposed on the economizer for heating the economizer, a controller for controlling the steam generator and the auxiliary heating devices, and a measurement system including pressure and/or temperature sensors, wherein the measurement system provides pressure and temperature measurements of the steam generator and temperature measurements of the system for readying the steam generator to the controller, and starting up of the steam generator and/or shutting down of the steam generator, wherein the step of starting up of the steam generator includes the following substeps:

using at least one of the first auxiliary heating device, the second auxiliary heating device, the third auxiliary heating device, the third auxiliary heating device, and the fourth auxiliary heating device to start heating the steam generator while recirculating the water through the steam generator, and wherein the step of shutting down of the steam generator includes:

keeping said at least one water-steam separator filled with water and blanketing said at least one water-steam separator with nitrogen or keeping the deaerator bottled up together with the third auxiliary heating device, keeping the economizer bottled up together with the fourth auxiliary heating device, keeping said at least one water-steam separator at least at the temperature in which materials making said at least one water-steam separator are no longer brittle with the first auxiliary heating device, and keeping the furnace top-end piping at least at the temperature in which materials making the furnace top-end piping are no longer brittle with the second auxiliary heating device, and wherein keeping the deaerator and the economizer bottled up includes limiting of gas diffusion into the water stored in the deaerator and the economizer.

13. The method of operating of the steam generator according to claim 12, wherein the steam generator is a sub-critical steam generator and said at least one water-steam separator is a boiler drum, and wherein the steam generator further comprises:

an economizer outlet feedwater line connecting the economizer and the boiler drum, at least one auxiliary heating source connected to the deaerator with a deaerator warming supply line, at least one downcomer connecting the boiler drum with the waterwall inlet header, a condenser connected to the heating system with a condensate supply line for providing condensate to the heating system, and wherein the condenser is connected with said at least one auxiliary heat source, and wherein the heating system is connected to the economizer with feedwater supply piping, wherein said at least one auxiliary heating source comprises a steam source, and wherein the system further comprises:

a fifth auxiliary heating device disposed at least on a part of the economizer outlet feedwater line for heating the economizer outlet feedwater line, and a boiler drum warming return line connecting said at least one downcomer with the condenser and/or connecting the waterwall inlet header with the condenser, and wherein the fifth auxiliary heating device is connected to said at least one auxiliary heating source with a boiler drum warming supply line, and wherein the step of starting up of the steam generator further includes:

heating water in the economizer outlet feedwater line with the fifth auxiliary heating device, wherein the substep of recirculating the water includes recirculation between the boiler drum, the deaerator and the economizer using the boiler drum warming return line, the condensate supply line and the feedwater supply piping.

14. The method of operating of the steam generator according to claim 12, wherein the steam generator is a super-critical steam generator, and and wherein said at least one water-steam separator includes:

a separator storage tank connected at the outlet of said at least one water-steam separator, and wherein the system further comprises:

a minimum economizer flow return line connecting the separator storage tank with the economizer, wherein the substep of recirculating the water includes recirculation the water between said at least one water-steam separator, the separator storage tank and the economizer using the minimum economizer flow return line.

* * * * *